US012460147B2

(12) United States Patent
Kimoto et al.

(10) Patent No.: US 12,460,147 B2
(45) Date of Patent: Nov. 4, 2025

(54) COMPOSITION FOR REFRIGERATION MACHINE AND COMPOSITION KIT FOR REFRIGERATION MACHINE

(71) Applicants: DAICEL CORPORATION, Osaka (JP); DAIKIN INDUSTRIES, LTD., Osaka (JP)

(72) Inventors: Norihiro Kimoto, Tokyo (JP); Hisayoshi Ito, Tokyo (JP); Kouichi Umemoto, Tokyo (JP); Takeru Kashiwagi, Tokyo (JP); Daisuke Shiro, Tokyo (JP); Hidekazu Takeuchi, Tokyo (JP); Hideki Matsuura, Osaka (JP); Shogo Moroe, Osaka (JP); Arisa Kawae, Osaka (JP); Masaru Tanaka, Osaka (JP)

(73) Assignees: DAICEL CORPORATION, Osaka (JP); DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/561,350

(22) PCT Filed: May 11, 2022

(86) PCT No.: PCT/JP2022/019979
§ 371 (c)(1),
(2) Date: Nov. 16, 2023

(87) PCT Pub. No.: WO2022/244665
PCT Pub. Date: Nov. 24, 2022

(65) Prior Publication Data

US 2024/0240101 A1 Jul. 18, 2024

(30) Foreign Application Priority Data

May 17, 2021 (JP) ..... 2021-082882

(51) Int. Cl.
*C10M 125/02* (2006.01)
*C10M 171/00* (2006.01)
(Continued)

(52) U.S. Cl.
CPC ..... *C10M 125/02* (2013.01); *C10M 171/008* (2013.01); *C10M 2201/041* (2013.01);
(Continued)

(58) Field of Classification Search
CPC ..... C10M 125/02; C10M 171/008; C10M 2201/041; C10N 2020/04; C10N 2020/06; C10N 2030/06; C10N 2040/30
See application file for complete search history.

(56) References Cited

U.S. PATENT DOCUMENTS 5,651,257 A * 7/1997 Kasahara ..... C10M 107/34 62/84
8,598,098 B2 * 12/2013 Nakagawa ..... B82Y 30/00 508/130
(Continued)

FOREIGN PATENT DOCUMENTS

CN 104152216 A 11/2014
JP 2000-88372 A 3/2000
(Continued)

OTHER PUBLICATIONS

English-language machine translation of WO 2020/095581 A1, filed by applicant on Feb. 8, 2024 (Year: 2020).*
(Continued)

*Primary Examiner* — James C Goloboy
(74) *Attorney, Agent, or Firm* — Birch, Stewart, Kolasch & Birch, LLP

(57) ABSTRACT

Provided is a composition for a refrigeration machine capable of reducing a friction coefficient in friction between sliding members in a refrigeration machine, and a compo-
(Continued)

sition kit for a refrigeration machine for providing the composition for a refrigeration machine. A composition for a refrigeration machine of the present disclosure includes a refrigeration machine oil, nanodiamond particles dispersed in the refrigeration machine oil, and a dispersant. The refrigeration machine oil preferably contains a polyvinyl ether, a polyol ester, a polyalkylene glycol, an alkylbenzene, or a mineral oil. The composition kit for a refrigeration machine of the present disclosure includes a refrigeration machine oil (A) containing a base oil and nanodiamond particles dispersed in the base oil, and a refrigerant (B).

9 Claims, 12 Drawing Sheets

(51) Int. Cl.

| | |
|---|---|
| ***C10N 20/04*** | (2006.01) |
| ***C10N 20/06*** | (2006.01) |
| ***C10N 30/06*** | (2006.01) |
| ***C10N 40/30*** | (2006.01) |

(52) U.S. Cl.
CPC ..... *C10N 2020/04* (2013.01); *C10N 2020/06* (2013.01); *C10N 2030/06* (2013.01); *C10N 2040/30* (2013.01)

(56) References Cited

U.S. PATENT DOCUMENTS

| | | | | |
|---|---|---|---|---|
| 2006/0001002 | A1 | 1/2006 | Iwanami et al. | |
| 2013/0186114 | A1* | 7/2013 | Guerin | C09K 5/045 252/68 |
| 2021/0261878 | A1 | 8/2021 | Kimoto et al. | |
| 2021/0331928 | A1 | 10/2021 | Shiro et al. | |
| 2022/0259048 | A1 | 8/2022 | Kimoto et al. | |
| 2023/0331959 | A1 | 10/2023 | Kimoto et al. | |
| 2024/0309137 | A1* | 9/2024 | Ogata | C08F 220/1804 |

FOREIGN PATENT DOCUMENTS

| | | | | |
|---|---|---|---|---|
| JP | 2020-76044 | A | 5/2020 | |
| JP | 2020-180248 | A | 11/2020 | |
| JP | 2020-180249 | A | 11/2020 | |
| WO | WO 94/12594 | A1 | 6/1994 | |
| WO | WO 2020/026790 | A1 | 2/2020 | |
| WO | WO-2020095581 | A1 * | 5/2020 | C08L 101/02 |
| WO | WO 2020/241404 | A1 | 12/2020 | |
| WO | WO 2022/091725 | A1 | 5/2022 | |

OTHER PUBLICATIONS

Pico, D.F.M., da Silva, L.R.R., Mendoza, O.S.H., Filho, E.P.B., "Experimental study on thermal and tribological performance of diamond nanolubricants applied to a refrigeration system using R32", Int. J. Heat Mass Transf, 2020, 152, 119493 (Year: 2020).*

International Preliminary Report on Patentability and Written Opinion of the International Searching Authority for International Application No. PCT/JP2022/019979, dated Nov. 21, 2023, with an English translation.

International Search Report for International Application No. PCT/JP2022/019979, dated Jun. 28, 2022, with English translation.

Extended European Search Report for European Application No. 22804578.7, dated Mar. 21, 2025.

Marcucci Pico et al., "Experimental study on thermal and tribological performance of diamond nanolubricants applied to a refrigeration system using R32," International Journal of Heat and Mass Transfer, vol. 152, Feb. 19, 2020, pp. 1-11.

* cited by examiner

COMPOSITION FOR REFRIGERATION MACHINE AND COMPOSITION KIT FOR REFRIGERATION MACHINE

TECHNICAL FIELD

The present disclosure relates to a composition for a refrigeration machine and a composition kit for a refrigeration machine. More specifically, the present disclosure relates to a composition for a refrigeration machine including a refrigeration machine oil and a composition kit for a refrigeration machine that is a kit for providing the composition for a refrigeration machine. The present application claims priority to JP 2021-082882, filed in Japan on May 27, 2021, the content of which is incorporated herein.

BACKGROUND ART

Refrigeration machines such as compression type refrigeration machines typically include a compressor, a condenser, an expansion mechanism (expansion valve or the like), and an evaporator, and have a structure in which a mixture of a refrigerant and a refrigeration machine oil (composition for a refrigeration machine) circulates in a sealed system.

In a compressor for a refrigeration machine, a refrigeration machine oil is used to reduce friction generated between various sliding members. The refrigeration machine oil is sealed in the compressor together with a refrigerant and lubricates sliding members such as a connecting rod and a piston.

As the composition for a refrigeration machine, for example, a lubricating oil composition containing a specific base oil and a specific nanodiamond is known (see Patent Document 1). It is described that the lubricant composition is excellent in friction characteristics.

CITATION LIST

Patent Document

Patent Document 1: JP 2020-180248 A
Patent Document 2: JP 2020-76044 A
Patent Document 3: WO 2020/026790

SUMMARY OF INVENTION

Technical Problem

In compressors for refrigeration machines and the like, a known antiwear agent such as a phosphoric acid ester or a known oiliness improver is used, but there is a possibility that wear or seizure occurs in a mixed lubrication state generated depending on a construction state or an operation condition, and the device is damaged. Although it is described that the lubricant composition described in Patent Document 1 is excellent in friction characteristics, there is a concern about the dispersibility of the nanodiamond particles in the base oil, and there is a possibility that the reduction of the friction coefficient is insufficient.

Patent Document 2 discloses a lubricant composition for initial running-in containing nano-carbon particles. Patent Document 3 discloses a dispersion in which a specific surface-modified nanodiamond is dispersed in an organic solvent.

However, Patent Document 2 does not disclose a simulation test (for example, a ring-on-disk friction test) of friction generated in a compressor for a refrigeration machine. Patent Document 3 does not disclose that the dispersion exhibits an effect of a lubricant between sliding members in a refrigeration machine. Patent Documents 2 and 3 do not disclose that the lubricant composition or the dispersion is used as a refrigeration machine oil or used as a composition for a refrigeration machine in combination with a refrigerant.

An object of the present disclosure is to provide a composition for a refrigeration machine capable of reducing a friction coefficient in friction between sliding members in a refrigeration machine, and a composition kit for a refrigeration machine for providing the composition for a refrigeration machine.

Solution to Problem

As a result of intensive studies to achieve the above object, the inventors of the present disclosure have found that a composition for a refrigeration machine including a refrigeration machine oil, nanodiamond particles dispersed in the refrigeration machine oil, and a dispersant can reduce a friction coefficient in friction between sliding members in a refrigeration machine. The present disclosure relates to the solution achieved based on these findings.

The present disclosure provides a composition for a refrigeration machine including a refrigeration machine oil, nanodiamond particles dispersed in the refrigeration machine oil, and a dispersant.

The refrigeration machine oil preferably contains a polyvinyl ether, a polyol ester, a polyalkylene glycol, an alkylated aromatic hydrocarbon compound, or a mineral oil.

The dispersant preferably includes a dispersant (I) having a mass-average molecular weight of 500 or more and an amine value of 15 mg KOH/g or more and/or a fatty acid ester-based dispersant (II).

The refrigeration machine oil preferably has an SP value of from 6.0 to 12.0 $(cal/cm^3)^{1/2}$.

The composition for a refrigeration machine preferably has a friction coefficient of 0.08 or less when the composition is used as a lubricant in a ring-on-disk friction test under conditions of a surface pressure of 2 MPa and a speed of 1.5 m/s.

The composition for a refrigeration machine is preferably for use in a compressor of a refrigeration machine.

The refrigeration machine is preferably an air conditioner.

The present disclosure also provides a composition kit for a refrigeration machine including a refrigeration machine oil (A) containing a base oil and nanodiamond particles dispersed in the base oil, and a refrigerant (B).

The refrigeration machine oil (A) preferably has a friction coefficient of 0.08 or less when the refrigeration machine oil (A) is used as a lubricant in a ring-on-disk friction test under conditions of a surface pressure of 2 MPa and a speed of 1.5 m/s.

Advantageous Effects of Invention

The composition for a refrigeration machine of the present disclosure can reduce a friction coefficient in friction between sliding members in a refrigeration machine. The composition for a refrigeration machine of the present disclosure can also reduce the friction coefficient at an early stage. The composition kit for a refrigeration machine of the present disclosure can provide the composition for a refrigeration machine by mixing a refrigeration machine oil and a refrigerant.

DESCRIPTION OF EMBODIMENTS

[Composition for Refrigeration Machine]

Figure 1:
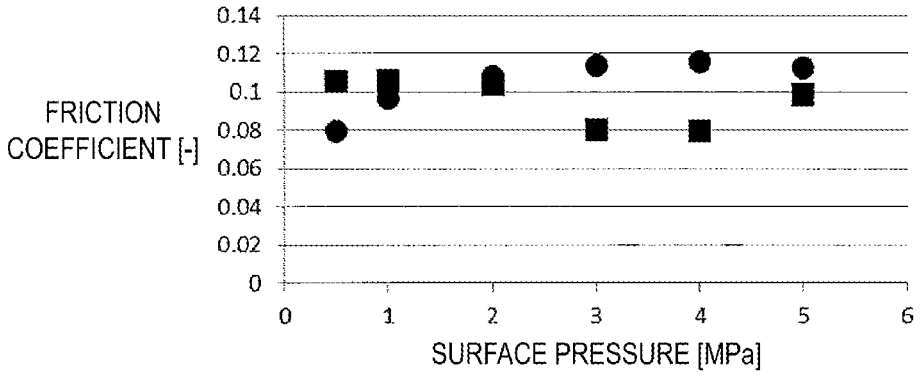
FIG. 1 is a graph illustrating friction coefficients measured by a ring-on-disk friction test (in the atmosphere, at a sliding speed of 0.5 m/s) when compositions for a refrigeration machine of Example 1 and Comparative Example 1 were used as lubricants.

A composition for a refrigeration machine according to an embodiment of the present disclosure includes at least a refrigeration machine oil, nanodiamond particles dispersed in the refrigeration machine oil, and a dispersant. The composition for a refrigeration machine is used by filling an inside of a refrigeration machine therewith. The nanodiamond particles are dispersed at least in the refrigeration machine oil.

(Refrigeration Machine Oil)

As the refrigeration machine oil, known or commonly used refrigeration machine oils such as synthetic oils and mineral oils used in known compositions for refrigeration machines may be used. Examples of the refrigeration machine oil include polyvinyl ethers (PVE), polyol esters (POE), polyalkylene glycols (PAG), polyesters, polycarbonates, hydrides of α-olefin oligomers, alicyclic hydrocarbon compounds, alkylated aromatic hydrocarbon compounds such as alkylbenzenes (AB), and mineral oils. Examples of the mineral oil include: oils obtained by purifying, through solvent deasphalting, solvent extraction or hydrocracking, solvent dewaxing or catalytic dewaxing, hydrorefining or the like, a lubricating oil fraction obtained by vacuum distillation of atmospheric residue obtained by subjecting atmospheric distillation to crude oil such as paraffinic crude oil, mixed base crude oil, or naphthenic crude oil; oils produced by isomerization of mineral oil-based wax; and oils produced by hydroisomerization dewaxing of residual WAX (gas-to-liquid wax) in a GTL process including a Fischer-Tropsch process or the like. Of these, polyvinyl ethers, polyol esters, polyalkylene glycols, alkylated aromatic hydrocarbon compounds, and mineral oils are preferable from the viewpoint of excellent dispersibility of the nanodiamond particles, compatibility with a refrigerant, and hydrolysis resistance. One type of the refrigeration machine oils may be used, or two or more types thereof may be used.

The polyvinyl ethers are polymers containing a structural unit derived from a vinyl ether. Of these, from the viewpoint of obtaining more excellent stability, a polymer containing a constituent unit derived from a vinyl ether having an alkyl group having from 1 to 4 carbons in a side chain is preferable.

An SP value [Hildebrand solubility parameter (6), at 25° C. in $(cal/cm^3)^{1/2}$] of the refrigeration machine oil is preferably from 6.0 to 12.0, and more preferably from 6.0 to less than 11.0. The refrigeration machine oil having an SP value within the above-described range has excellent dispersibility of the nanodiamond particles and excellent compatibility with a refrigerant.

The proportion of the refrigeration machine oil contained in the composition for a refrigeration machine is not particularly limited, and is, for example, from 1 to 99 mass %, preferably from 20 to 95 mass % with respect to the total amount of the composition for a refrigeration machine.

Nanodiamond Particles

The nanodiamond particles are not limited, and publicly known or commonly used nanodiamond particles may be used. The nanodiamond particles may be nanodiamond particles whose surfaces are modified (surface-modified nanodiamond particles) or may be nanodiamond particles whose surfaces are not modified. Nanodiamond particles whose surfaces are not modified have hydroxy groups (—OH) or carboxy groups (—COOH) on the surfaces. One type of the nanodiamond particles may be used, or two or more types thereof may be used.

The nanodiamond particles preferably contain primary particles of nanodiamond. In addition, the nanodiamond particles may contain secondary particles in which a plurality of the primary particles are aggregated.

As the nanodiamond particles, for example, a detonation nanodiamond (that is, nanodiamond produced by a detonation method) or a high-temperature high-pressure nanodiamond (that is, nanodiamond produced by a high-temperature high-pressure method) may be used. Of these, a detonation nanodiamond is preferable in that its dispersibility in the composition for a refrigeration machine is better, that is, in that primary particles have a particle size of a single-digit nanometer.

Examples of the detonation nanodiamond include an air-cooled detonation nanodiamond (that is, nanodiamond produced by an air-cooled detonation method) and a water-cooled detonation nanodiamond (that is, nanodiamond produced by a water-cooled detonation method). Of these, an air-cooled detonation nanodiamond is preferred in that primary particles are smaller than those of a water-cooled detonation nanodiamond.

Examples of the compound or functional group for modifying the surfaces of the nanodiamond particles in the surface-modified nanodiamond include a silane compound, a phosphonate ion or a phosphonate residue, a surface-modifying group having a vinyl group at a terminal, an amide group, a cation of a cationic surfactant, a group containing a polyglycerin chain, and a group containing a polyethylene glycol chain.

The compound or the functional group for modifying the surfaces of the nanodiamond particles in the surface-modified nanodiamond preferably includes an organic group. The organic group is more preferably an organic group having 4 or more (for example, from 4 to 25) carbons, more preferably an organic group having 6 or more (for example, from 6 to 22) carbons, and particularly preferably an organic group having 8 or more (for example, from 8 to 20) carbons. When the surface-modifying compound or the surface-modifying functional group includes an organic group (in particular, an organic group having 4 or more carbons), the hydrophobic interaction between the organic group and the refrigeration machine oil further improves the dispersibility of the nanodiamond particles in the refrigeration machine oil. Examples of the organic group include a substituted or unsubstituted hydrocarbon group, a substituted or unsubstituted heterocyclic group, and a group in which two or more of the aforementioned hydrocarbon group and/or the aforementioned heterocyclic group are bonded. Specific examples of the organic group include organic groups of the monovalent organic groups exemplified and described as R in Formula (I) described below.

The surface-modifying group is preferably a group represented by Formula (I) below. That is, the nanodiamond particles preferably include a surface-modified nanodiamond (nanodiamond particles) in which surfaces of the nanodiamond particles are modified by a group represented by Formula (I) below:

$$—X—R \quad (I)$$

where X represents a linking group, and a bond extending left from X binds to the nanodiamond, R represents a monovalent organic group, and an atom that binds to X is a carbon atom.

In Formula (I), X represents a linking group, such as an amino group (—$NR^a$—), an ether bond (—O—), an ester bond (—C(=O)O—), a phosphinate group (—PH(=O)O—), a phosphonate group (—P(—OH)(=O)O—), a phosphate ester (—O—P(=O)(OH)—O—), a sulfide bond (—S—), a carbonyl group (—C(=O)—), an amide group (—C(=O)—$NR^a$—), a urethane bond (—$R^a$H—C(=O)—O—), an imide bond (—C(=O)—$NR^a$—C(=O)—), a thiocarbonyl group (—C(=S)—), a siloxane bond (—Si—O—), a sulfate ester group (—O—S(=O)$_2$—O—), a sulfonyl group (—S(=O)$_2$—O—), a sulfone group (—S(=O)$_2$—), a sulfoxide (—S(=O)—), or a group in which two or more of those listed above are bonded. In an asymmetric divalent group, the direction of the divalent group with respect to the nanodiamond side or the R side is not limited. $R^a$ represents a hydrogen atom or a monovalent organic group. Examples of the monovalent organic group of $R^a$ include those exemplified and described as the monovalent organic group of R.

Examples of the monovalent organic group of R include a substituted or unsubstituted hydrocarbon group (a monovalent hydrocarbon group), a substituted or unsubstituted heterocyclic group (a monovalent heterocyclic group), and a group in which two or more of the aforementioned monovalent hydrocarbon group and/or the aforementioned monovalent heterocyclic group are bonded. The bonded groups may be directly bonded or may be bonded via a linking group. Examples of the linking group include an amino group, an ether bond, an ester bond, a phosphinate group, a sulfide bond, a carbonyl group, an organic group-substituted amide group, an organic group-substituted urethane bond, an organic group-substituted imide bond, a thiocarbonyl group, a siloxane bond, and a group in which two or more of those listed above are bonded.

Examples of the hydrocarbon group of the monovalent organic group include an aliphatic hydrocarbon group, an alicyclic hydrocarbon group, an aromatic hydrocarbon group, and a group in which two or more of those listed above are bonded.

Examples of the aliphatic hydrocarbon group include an alkyl group, an alkenyl group, and an alkynyl group. Examples of the alkyl group include a $C_{1-22}$ alkyl group, such as a methyl group, an ethyl group, a propyl group, an isopropyl group, a butyl group, a hexyl group, an octyl group, an isooctyl group, a decyl group, and a dodecyl group (preferably a $C_{2-20}$ alkyl group, and more preferably a $C_{3-18}$ alkyl group). Examples of the alkenyl group include a $C_{2-22}$ alkenyl group, such as a vinyl group, an allyl group, a methallyl group, a 1-propenyl group, an isopropenyl group, a 1-butenyl group, a 2-butenyl group, a 3-butenyl group, a 1-pentenyl group, a 2-pentenyl group, a 3-pentenyl group, a 4-pentenyl group, a 5-hexenyl group, and an oleyl group (preferably a $C_{4-20}$ alkenyl group, and more preferably a $C_{8-18}$ alkenyl group). Examples of the alkynyl group include a $C_{2-22}$ alkynyl group, such as an ethynyl group and a propynyl group (preferably a $C_{4-20}$ alkynyl group, and more preferably a $C_{8-18}$ alkynyl group).

Examples of the alicyclic hydrocarbon group include: a $C_{3-12}$ cycloalkyl group, such as a cyclopropyl group, a cyclobutyl group, a cyclopentyl group, a cyclohexyl group, and a cyclododecyl group; a $C_{3-12}$ cycloalkenyl group, such as a cyclohexenyl group; and a $C_{4-15}$ crosslinked cyclic hydrocarbon group, such as a bicycloheptanyl group and a bicycloheptenyl group.

Examples of the aromatic hydrocarbon group include a $C_{6-14}$ aryl group, such as a phenyl group and a naphthyl group (especially, a $C_{6-10}$ aryl group).

Examples of the heterocycle that forms the heterocyclic group include an aromatic heterocycle and a non-aromatic heterocycle. Examples of such a heterocycle include a 3 to 10-membered ring (preferably a 4 to 6-membered ring) having a carbon atom and at least one heteroatom (e.g., oxygen atom, sulfur atom, and nitrogen atom) as atoms constituting the ring, and a condensed ring thereof. Specific examples thereof include heterocycles containing an oxygen atom as a heteroatom (e.g., 3-membered rings, such as an oxirane ring; 4-membered rings, such as an oxetane ring; 5-membered rings, such as a furan ring, a tetrahydrofuran ring, an oxazole ring, an isoxazole ring, and a 7-butyrolactone ring; 6-membered rings, such as a 4-oxo-4H-pyran ring, a tetrahydropyran ring, and a morpholine ring; condensed rings, such as a benzofuran ring, an isobenzofuran ring, a 4-oxo-4H-chromene ring, a chroman ring, and an isochroman ring; crosslinked rings, such as a 3-oxatricyclo[4.3.1.1$^{4,8}$]undecan-2-one ring and a 3-oxatricyclo[4.2.1.0$^{4,8}$]nonan-2-one ring), heterocycles containing a sulfur atom as a heteroatom (e.g., 5-membered rings, such as a thiophene ring, a thiazole ring, an isothiazole ring, and a thiadiazole ring; and 6-membered rings, such as a 4-oxo-4H-thiopyran ring; condensed rings, such as a benzothiophene ring), and heterocycles containing a nitrogen atom as a heteroatom (e.g., 5-membered rings, such as a pyrrole ring, a pyrrolidine ring, a pyrazole ring, an imidazole ring, and a triazole ring; 6-membered rings, such as an isocyanuric ring, a pyridine ring, a pyridazine ring, a pyrimidine ring, a pyrazine ring, a piperidine ring, and a piperazine ring; condensed rings, such as an indole ring, an indoline ring, a quinoline ring, an acridine ring, a naphthyridine ring, a quinazoline ring, and a purine ring).

Furthermore, examples of the group in which an aliphatic hydrocarbon group and an alicyclic hydrocarbon group are bonded include a cyclohexylmethyl group and a methylcyclohexyl group. Examples of the group in which an aliphatic hydrocarbon group and an aromatic hydrocarbon group are bonded include a $C_{7-18}$ aralkyl group (particularly, a $C_{7-10}$ aralkyl group), such as a benzyl group and a phenethyl group; a $C_{6-10}$ aryl-$C_{2-6}$ alkenyl group, such as a cinnamyl group; a $C_{1-4}$ alkyl-substituted aryl group, such as a tolyl group; and a $C_{2-4}$ alkenyl-substituted aryl group, such as a styryl group.

Examples of the group in which two or more of the monovalent hydrocarbon group and/or the monovalent heterocyclic group are bonded via a linking group include a group in which the monovalent hydrocarbon group and/or the monovalent heterocyclic group is bonded to an alkoxy group, an alkenyloxy group, an alkynyloxy group, an aryloxy group, an aralkyloxy group, an acyloxy group, an alkylthio group, an alkenylthio group, an arylthio group, an aralkylthio group, an acyl group, an alkenylcarbonyl group, an arylcarbonyl group, an aralkylcarbonyl group, an alkoxycarbonyl group, an alkenyloxycarbonyl group, an aryloxycarbonyl group, an aralkyloxycarbonyl group, a dialkylamino group, an acylamino group, an oxetanyl group-containing group, or a carbamoyl group; or a group in which the monovalent hydrocarbon group and/or the monovalent heterocyclic group is bonded to two or more of the groups listed above.

The monovalent organic group may have a substituent. Examples of the substituent include: a halogen atom, such as a fluorine atom, a chlorine atom, a bromine atom, and an iodine atom; a cyano group; an isocyanate group; an isothiocyanate group; a hydroxy group; a carboxy group; an amino group; a monosubstituted amino group; a thiol group; and a phosphate group.

The group represented by Formula (I) is particularly preferably a group represented by Formula (1) below or a group containing a polyglycerin chain.

$$—X^1—R^1 \quad (1)$$

where $X^1$ represents —O—Si—, —Si—, —NH—, —O—, —O—C(=O)—, —C(=O)—O—, —NH—C(=O)—, —C(=O)—NH—, or —S—, and a bond extending left from $X^1$ binds to the nanodiamond, $R^1$ represents a substituted or unsubstituted monovalent hydrocarbon group, and an atom that binds to $X^1$ is a carbon atom.

The number of carbons in $R^1$ is preferably from 4 to 25, more preferably from 6 to 22, and still more preferably from 8 to 20. When the number of carbons is 4 or more, the steric hindrance between the surface-modifying groups becomes sufficient, and dispersion in the refrigeration machine oil is facilitated. When the number of carbons is 25 or less, the surface-modifying groups are kept from being entangled, and dispersion in the refrigeration machine oil is facilitated.

The monovalent hydrocarbon group in $R^1$ may have the substituent described above. Furthermore, the monovalent hydrocarbon group is preferably free of functional groups containing active hydrogen (such as a hydroxy group, a carboxy group, an amino group, a monosubstituted amino group, a thiol group, and a phosphate group).

$R^1$ preferably contains a hydrocarbon group having 4 or more consecutive carbon atoms in a linear chain. Examples of such a hydrocarbon group include a linear alkylene group, such as a tetramethylene group, a pentamethylene group, a hexamethylene group, a heptamethylene group, an octamethylene group, a nonamethylene group, and a decamethylene group; a branched alkylene group, such as a 2-ethylhexamethylene group; a linear alkenylene group, such as a 1-butenylene group, a 2-butenylene group, a 1-pentenylene group, a 2-pentenylene group, and a 3-pentenylene group; a branched alkenylene group, such as a 2-methyl-2-butenylene group; an alicyclic hydrocarbon group having 4 or more carbons, such as a cyclohexyl group; and an aromatic hydrocarbon group having 6 or more carbons, such as a phenyl group.

In Formula (1), a molar ratio of carbon atoms to a total amount of heteroatoms selected from the group consisting of nitrogen atoms, oxygen atoms, sulfur atoms, and silicon atoms is preferably 4.5 or greater, more preferably 5 or greater, and still more preferably 5.5 or greater. When the molar ratio is 4.5 or greater, more excellent dispersibility in the refrigeration machine oil is obtained. The molar ratio is not particularly limited and may be, for example, 22 or less, or 20 or less.

In Formula (1), $X^1$ is preferably —O—Si—, —O—, —O—C(=O)—, —C(=O)—O—, or —NH—. In this case, the surface-modified nanodiamond having excellent dispersibility in the refrigeration machine oil can be more easily produced.

In Formula (1), when $X^1$ is —O—Si—, —O—, —O—C(=O)—, or —C(=O)—O—, $R^1$ is more preferably a linear or branched hydrocarbon group having from 8 to 20 carbons.

In Formula (1), when $X^1$ is —NH—, $R^1$ is preferably a substituted or unsubstituted aliphatic hydrocarbon group containing from 8 to 20 carbon atoms, and more preferably a substituted or unsubstituted unsaturated aliphatic hydrocarbon group. Furthermore, when X is —NH—, $R^1$ is preferably a monovalent hydrocarbon group containing a hydrocarbon group having 4 or more consecutive carbon atoms in a linear chain.

Examples of the group containing a polyglycerin chain include a group having a polyglyceryl group, and a group in which at least a part of hydrogen atoms of hydroxy groups of the polyglyceryl group are substituted with monovalent organic groups.

The group containing a polyglycerin chain is preferably a polyglycerin chain-containing surface-modifying group represented by Formula (2) below.

$$—(X^2C_3H_5)—(OC_3H_5)p—(X^3R^2)q \quad (2)$$

where, p represents an integer of 1 or more, and q represents an integer satisfying q=p+2; $X^2$ represents a divalent group, and a bond extending left from $X^2$ in $[X^2C_3H_5]$ binds to the nanodiamond. $[X^3R^2]$ represents a terminal of the polyglycerin chain, $X^3$ represents a single bond or a divalent group, and $R^2$ represents a hydrogen atom or a monovalent organic group.

$[X^2C_3H_5]$ in Formula (2) is represented by $[—X^2—CH_2—C(—)H—CH_2—]$. $X^2$ in $[X^2C_3H_5]$ binds to the nanodiamond, and the two C atoms each bind to 0 in $[OC_3H_5]$ or $X^3$ in $[X^3R^2]$. $X^2$ in $[X^2C_3H_5]$ represents a divalent group.

Examples of the divalent group includes the divalent groups exemplified and described as X in Formula (I). Of these, the divalent group is preferably $—NR^a—$, —O—, —C(=O)O—, —PH(=O)O—, or —S—, and more preferably $—NR^a—$, —O—, or —C(=O)O—.

$[OC_3H_5]$ with p in Formula (2) is a structure derived from glycerin represented by $[—O—CH_2—C(—)H—CH_2-]$ and forms a polyglycerin chain together with $[X^2C_3H_5]$. p represents a repeating unit of $[OC_3H_5]$ and is an integer of 1 or more, preferably from 3 to 20, and more preferably from 5 to 15. p may be the same or different in the group containing a plurality of polyglycerin chains.

In Formula (2), $[X^3R^2]$ represents a terminal of the polyglycerin chain and binds to C in $[X^2C_3H_5]$ or C in $[OC_3H_6]$. $R^2$ represents a hydrogen atom or a monovalent organic group.

$X^3$ in $[X^3R^2]$ represents a single bond or a divalent group, and examples of the divalent group include the divalent groups exemplified and described as $X^2$ in $[X^2C_3H_5]$. Of these, $X^3$ is preferably $—NR^a—$, —O—, —C(=O)O—, —O—C(=O)—, —PH(=O)O—, —O—P(=O)(OH)—O—, —S—, $—O—S(=O)_2—O—$, or $—O—S(=O)_2—$, and more preferably $—NR^a—$ or —O—. $X^2$ in $[X^2C_3H_6]$ and $X^3$ in $[X^3R^2]$ may be the same or different. The plurality of $[X^3R^2]$s may be the same or different. $X^3$ in $[X^3R^2]$ may be the same or different in the group containing the plurality of polyglycerin chains. q represents an integer of 3 or more, and the value of q depends on the value of p and satisfies q=p+2. q may be the same or different in the group containing a plurality of polyglycerin chains.

When $R^2$ is a monovalent organic group, the plurality of $R^2$s in Formula (2) are preferably the same. Examples of the monovalent organic group include those exemplified and described as the monovalent organic group represented by R in Formula (1). Specifically, examples of the monovalent organic group include a substituted or unsubstituted hydrocarbon group (monovalent hydrocarbon group), a substituted or unsubstituted heterocyclic group (monovalent heterocyclic group), and a group in which two or more of these groups are bonded. The monovalent organic group may have an ionic form.

The bonded groups may be directly bonded or may be bonded via a linking group. The hydrocarbon group in the substituted or unsubstituted hydrocarbon group is preferably an alkyl group, more preferably an alkyl group having from 1 to 18 carbons, still more preferably an alkyl group having from 1 to 6 carbons, and particularly preferably an ethyl group, a propyl group, a butyl group, or a hexyl group.

Specific examples of $[X^3R^2]$ include OH, $NH_2$, $CH_3$, an alkoxy group, an acyl group, a mono- or di-alkylamino group, a mono- or di-alkenylamino group, an alkylamide group, an alkenylamide group, a quaternary ammonium-substituted alkoxy group, a chlorine-substituted alkoxy group, and a polyalkylene oxide group.

The number-average degree of polymerization of glycerin in the polyglycerin chain is preferably from 1 to 100, more preferably from 2 to 40, and still more preferably from 3 to 20. When the number-average degree of polymerization is large, the repulsive force between nanodiamond sufficiently acts, which can further improve the dispersibility of the nanodiamond in the composition for a refrigeration machine. When the number-average degree of polymerization is 100 or less, entanglement of polyglycerin chains between the nanodiamond particles is suppressed, which can further improve the dispersibility of the nanodiamond particles in the composition for a refrigeration machine. The number-average degree of polymerization is defined as the number of glycidol units constituting a polyglycerin chain in a group bonded to a surface functional group 1 of the raw material nanodiamond. The number of surface functional groups of the raw material nanodiamond may be obtained by element analysis or acid number measurement of the raw material nanodiamond, or by these techniques in combination.

A mass ratio of the nanodiamond to the surface-modifying group [nanodiamond/surface-modifying group] in the surface-modified nanodiamond is not limited, and is preferably from 0.5 to 1.0, and more preferably from 0.6 to 0.8. When the mass ratio is 0.5 or more, in particular, 0.6 or more, the properties of nanodiamond are less likely to be impaired. When the mass ratio is 1.0 or less, in particular, 0.8 or less, the degree of modification of the surface-modifying group is sufficient, and more excellent dispersibility in the refrigeration machine oil is obtained. The mass ratio can be determined based on a weight loss rate as measured by thermogravimetric analysis, and the weight loss is considered as the mass of the surface-modifying group.

In the composition for a refrigeration machine, the nanodiamond particles are dispersed in the refrigeration machine oil. In the composition for a refrigeration machine, the nanodiamond particles are preferably dispersed in nanometer order. An average dispersed particle size (D50, median diameter) of the nanodiamond particles in the composition for a refrigeration machine is preferably from 2 to 240 nm, more preferably from 4 to 200 nm, still more preferably from 5 to 100 nm, still more preferably from 6 to 70 nm, still more preferably from 10 to 60 nm, still more preferably from 10 to 40 nm, and particularly preferably from 11 to 30 nm. The average dispersed particle size can be measured using a dynamic light scattering method, When the average dispersed particle size of the nanodiamond particles is within the range described above, excellent dispersibility of the nanodiamond particles in the composition for a refrigeration machine is obtained, and the friction coefficient can be sufficiently reduced.

The proportion of the nanodiamond particles contained in the composition for a refrigeration machine is preferably from 1 to 10,000 mass ppm, more preferably from 5 to 1000 mass ppm, and still more preferably from 10 to 500 mass ppm with respect to the total amount of the refrigeration machine oil. When the proportion is 1 mass ppm or more, the friction coefficient in friction between sliding members in a refrigeration machine can be more sufficiently reduced.

When the proportion is within the range described above, more excellent dispersibility of nanodiamond particles is obtained. The composition for a refrigeration machine may be a concentrated liquid that is to be diluted at the time of use to obtain a reduced proportion of the nanodiamond particles. Thus, the proportion may be more than 10,000 mass ppm or 2 mass % or more. The composition for a refrigeration machine, which is excellent in dispersibility of the nanodiamond particles, can disperse the nanodiamond particles with a small dispersed particle size while reducing the addition amount of the dispersant even when the proportion is more than 10,000 mass ppm. From the viewpoint of achieving more excellent dispersibility of the nanodiamond particles, the proportion is preferably 10 mass % or less.

The proportion of the nanodiamond particles can be calculated from the absorbance at 350 nm. When the proportion of the surface-modified nanodiamond particles is small (e.g., 2000 mass ppm or less), the proportion may be determined based on a detected amount of a compound that modifies the surfaces of the nanodiamond particles, which is detected through high frequency inductively coupled plasma emission spectroscopy (ICP emission spectroscopy).

Dispersant

The composition for a refrigeration machine contains a dispersant. Blending a dispersant improves the dispersibility of the nanodiamond particles in the refrigeration machine oil. As the dispersant, a dispersant having a mass-average molecular weight of 500 or more and an amine value of 15 mg KOH/g or more (which may be referred to as "dispersant (I)") and a fatty acid ester-based dispersant (which may be referred to as "dispersant (II)") are preferable. Using such dispersants achieves more excellent dispersibility of the nanodiamond particles in the composition for a refrigeration machine. One type of the dispersant may be used, or two or more types thereof may be used.

The mass-average molecular weight of the dispersant (I) is 500 or more, preferably 650 or more, and more preferably 950 or more. The mass-average molecular weight is preferably 20000 or less, and more preferably 10000 or less. Note that the mass-average molecular weight in the present specification is a molecular weight measured by gel permeation chromatography (GPC) and calibrated with a polystyrene standard.

The amine value of the dispersant (I) is 15 mg KOH/g or more, preferably 18 mg KOH/g or more, more preferably 20 mg KOH/g or more, and still more preferably 30 mg KOH/g or more. Furthermore, the amine value is preferably 100 mg KOH/g or less, more preferably 90 mg KOH/g or less, and still more preferably 60 mg KOH/g or less.

Especially, the dispersant (I) is preferably a compound having a structure derived from a polyalkylene glycol monoalkyl ether, in particular, a structure derived from a polyethylene glycol monoalkyl ether or a structure derived from a polypropylene glycol monoalkyl ether, a compound having a carbamate structure, and a compound having a structure derived from polycaprolactone. One type of the compounds may be contained, or two or more types thereof may be contained. One compound alone may include one or more of the structures described above.

A commercially available product of the dispersant (I) may be used. Examples of the commercially available product of the dispersant (I) include a product under the trade name "DISPERBYK-2008", a product under the trade name "BYK-9076", a product under the trade name "BYK-9077", and a product under the trade name "ANTI-TERRA-U", all available from BYK-Chemie GmbH.

An acid value of the dispersant (II) is preferably 40 mg KOH/g or less, more preferably 35 mg KOH/g or less, more preferably 30 mg KOH/g or less, still more preferably 20 mg KOH/g or less, and particularly preferably 6 mg KOH/g or less. The acid value may be, for example, 0.1 mg KOH/g or more, 0.3 mg KOH/g or more, or 0.5 mg KOH/g or more. When the acid value is 40 mg KOH/g or less, in particular, 30 mg KOH/g or less, more excellent dispersibility in the refrigeration machine oil tends to be obtained.

An amine value of the dispersant (II) is preferably 5 mg KOH/g or less, more preferably 1 mg KOH/g or less, still more preferably 0.5 mg KOH/g or less, still more preferably 0.1 mg KOH/g or less, and particularly preferably 0 mg KOH/g.

An average molecular weight Mp of the dispersant (II) is preferably 300 or more, more preferably 1000 or more (for example, from 1000 to 100,000), and still more preferably 3000 or more (for example, from 3000 to 10,000). When the average molecular weight Mp is 300 or more, more excellent dispersibility in the refrigeration machine oil tends to be obtained. Note that the average molecular weight Mp is a molecular weight measured by gel permeation chromatography (GPC) and calibrated with a polystyrene standard.

A mass loss rate of the dispersant (II) when the dispersant (II) is held in an air atmosphere at a temperature of 200° C. for 180 minutes (which may be referred to as "mass loss rate at 200° C. for 180 minutes") is preferably 30% or less, more preferably 25% or less, still more preferably 20% or less, and particularly preferably 15% or less. When the mass loss rate is 30% or less, the composition for a refrigeration machine has more excellent heat resistance and excellent dispersion stability in a high-temperature environment. The mass loss rate can be measured by thermogravimetric-differential thermal analysis (TG-DTA).

The dispersant (II) may have an acidic functional group. Examples of the acidic functional group include carboxylic acids, sulfonic acids, and salts thereof.

Examples of a fatty acid that constitutes the fatty acid ester-based dispersant serving as the dispersant (II) include carboxylic acids, sulfonic acids, and salts thereof. Examples of the carboxylic acid include aliphatic monocarboxylic acids such as acetic acid, propionic acid, caprylic acid, nonanoic acid, capric acid, octylic acid, lauric acid, myristic acid, palmitic acid, stearic acid, oleic acid, isononanoic acid, and arachidic acid; and aromatic monocarboxylic acids such as benzoic acid and p-(t-butylbutyl)benzoic acid. Examples of the sulfonic acid include naphthalenesulfonic acid. The fatty acid is preferably a higher fatty acid. That is, the dispersant (II) is preferably a higher fatty acid ester dispersant. One type of the fatty acids may be used, or two or more types thereof may be used.

Examples of a compound constituting the ester component of the fatty acid ester-based dispersant as the dispersant (II) include: a cyclic ester compound such as propiolactone, valerolactone, and caprolactone; a condensate of a glycol and a dibasic acid; and glycerin. In addition, a molecular weight of polyester in the fatty acid ester-based dispersant is preferably approximately from 300 to 9000, and more preferably from 400 to 6000. Specific examples of the dispersant (II) include glycerol monooleate.

A commercially available product of the dispersant (II) can be used. Examples of the commercially available product of the fatty acid ester-based dispersant include a product under the trade name "AJISPER PA111" and a product under the trade name "AJISPER PN411" (both available from Ajinomoto Fine-Techno Co., Inc.), and a product under the trade name "RHEODOL MO-60" (available from Kao Corporation).

Since the dispersant (II) have a high heat resistance, decomposition due to heat is unlikely to occur. Thus, even when the composition for a refrigeration machine is heated during use or used in a high-temperature environment, the composition for a refrigeration machine is excellent in dispersion stability in a high-temperature environment, and discoloration hardly occurs. Further, since the dispersant (II) are commercially available and easy to obtain, it does not need be produced via a complicated production process, leading to excellent ease of production.

The content of the dispersant in the composition for a refrigeration machine is preferably from 100 to 10,000 parts by mass, more preferably from 200 to 5000 parts by mass, and still more preferably from 400 to 2000 parts by mass with respect to 100 parts by mass of the total amount of the nanodiamond particles.

Refrigerant

The composition for a refrigeration machine oil may further contain a refrigerant. A known or commonly used refrigerant that is used in a known composition for a refrigeration machine can be used as the refrigerant. Examples of the refrigerant include a fluorinated hydrocarbon refrigerant, a hydrocarbon(HC)-based refrigerant that is a natural refrigerant, carbon dioxide, and ammonia. When the composition for a refrigeration machine oil contains a refrigerant, a part of the nanodiamond particles may be dispersed in the refrigerant. One type of the refrigerants may be used, or two or more types thereof may be used.

Especially, the refrigerant is preferably a fluorine-based hydrocarbon refrigerant. Examples of the fluorine-based hydrocarbon refrigerant include a saturated fluorine-based hydrocarbon refrigerant and an unsaturated fluorine-based hydrocarbon refrigerant.

Examples of the saturated fluorine-based hydrocarbon compound include fluorides of alkanes. The alkane is preferably an alkane having from 1 to 4 carbons, more preferably an alkane having from 1 to 3 carbons, and still more preferably an alkane having from 1 to 2 carbons. Specific examples of the fluoride of an alkane include trifluoromethane, difluoromethane, 1,1-difluoroethane, 1,1,1-trifluoroethane, 1,1,2-trifluoroethane, 1,1,1,2-tetrafluoroethane, 1,1,2,2-tetrafluoroethane, and 1,1,1,2,2-pentafluoroethane.

Examples of the unsaturated fluorine-based hydrocarbon refrigerant include fluorides of linear or branched chain olefins and fluorides of cyclic olefins.

As the linear or branched chain olefin, a linear or branched chain olefin having from 2 to 6 carbons is preferable. Examples of the fluoride of a chain olefin include ethylene with from 1 to 3 fluorine atoms introduced, propene with from 1 to 5 fluorine atoms introduced, butene with from 1 to 7 fluorine atoms introduced, pentene with from 1 to 9 fluorine atoms introduced, and hexene with from 1 to 11 fluorine atoms introduced.

The cyclic olefin is preferably a cyclic olefin having a hydrocarbon ring having from 4 to 6 carbons. Examples of the fluoride of a cyclic olefin include cyclobutene with from 1 to 5 fluorine atoms introduced, cyclopentene with from 1 to 7 fluorine atoms introduced, and cyclohexene with from 1 to 9 fluorine atoms introduced.

The HC-based refrigerant is preferably a hydrocarbon having from 1 to 8 carbons, more preferably a hydrocarbon having from 1 to 5 carbons, and still more preferably a hydrocarbon having from 3 to 5 carbons. When the number of carbon atoms of the hydrocarbon is 8 or less, the boiling point of the refrigerant does not become too high, which is preferable as a refrigerant. Specific examples of the HC-based refrigerant include methane, ethane, ethylene, propane, cyclopropane, propylene, n-butane, isobutane, 2-methylbutane, n-pentane, isopentane, cyclopentaneisobutane, and normal butane.

The proportion of the refrigerant contained in the composition for a refrigeration machine is, for example, from 1 to 99 mass %, and preferably from 2 to 95 mass % with respect to the total amount of the composition for a refrigeration machine.

Other Components

The composition for a refrigeration machine may include other components in addition to the components described above. Examples of the other components include known refrigeration machine oils, refrigerants, and known or commonly used components that may be contained in a composition for a refrigeration machine. Examples of the other components include an antioxidant, an oiliness improver, an extreme-pressure agent, an acid scavenger, an oxygen scavenger, a metal deactivator, a rust inhibitor, and an antifoaming agent. When the composition for a refrigeration machine contains the other additives, the proportion of the other additives is preferably from 0.05 to 5 mass %, more preferably from 0.1 to 3 mass %, and still more preferably from 0.2 to 2 mass % with respect to the total amount of the composition for a refrigeration machine. One type of each of the other components may be used, or two or more types thereof may be used.

As the extreme-pressure agent, a known or commonly used extreme-pressure agent that may be contained in a known composition for a refrigeration machine can be used. In particular, phosphorus-based extreme-pressure agents, metal salts of carboxylic acids, and sulfur-based extreme-pressure agents are preferable.

Examples of the phosphorus-based extreme-pressure agent include phosphoric acid esters, acidic phosphoric acid esters, phosphorous acid esters, acidic phosphorous acid esters, and amine salts thereof. Specific examples of the phosphorus-based extreme-pressure agent include tricresyl phosphate (TCP), trithiophenyl phosphate, tri(nonylphenyl) phosphite, dioleyl hydrogen phosphite, and 2-ethylhexyl diphenyl phosphite.

Examples of the metal salt of a carboxylic acid include metal salts of carboxylic acids having from 3 to 60 (preferably from 3 to 30) carbons. Of these, metal salts of fatty acids having from 12 to 30 carbons and metal salts of dicarboxylic acids having from 3 to 30 carbons are preferable. As a metal constituting the metal salt, an alkali metal or an alkaline earth metal is preferable, and an alkali metal is more preferable.

Examples of the sulfur-based extreme-pressure agent include sulfurized fats and oils, sulfurized fatty acids, sulfurized esters, sulfurized olefins, dihydrocarbyl polysulfides, thiocarbamates, thioterpenes, and dialkyl thiodipropionates.

The proportion of the extreme-pressure agent is preferably from 0.0005 to 3 mass % and more preferably from 0.002 to 2 mass % with respect to the total amount of the composition for a refrigeration machine from the viewpoint that the friction coefficient and the wear amount can be further reduced.

Composition for Refrigeration Machine

The composition for a refrigeration machine preferably has a haze value of 5 or less, more preferably 3 or less, and still more preferably 1 or less. Since the composition for a refrigeration machine is excellent in dispersibility of the nanodiamond particles, a composition for a refrigeration machine having the haze value described above can be obtained. The haze value can be measured based on JIS K 7136.

The composition for a refrigeration machine preferably has a friction coefficient of 0.08 or less, more preferably 0.05 or less, still more preferably 0.04 or less, and particularly preferably 0.03 or less when used as a lubricant in a ring-on-disk friction test under the conditions of a surface pressure of 2 MPa and a speed of 1.5 m/s. When the friction coefficient is 0.08 or less, the friction coefficient and the wear amount of the sliding member tend to be further reduced.

The composition for a refrigeration machine is obtained, for example, by mixing a refrigeration machine oil (A) containing a refrigeration machine oil and nanodiamond particles dispersed in the refrigeration machine oil with a refrigerant (B). The refrigeration machine oil (A) and the refrigerant (B) may be combined to form a composition kit for a refrigeration machine, and the composition for a refrigeration machine may be produced by mixing the refrigeration machine oil (A) and the refrigerant (B) before use.

Composition Kit for Refrigeration Machine

The composition kit for a refrigeration machine includes at least the refrigeration machine oil (A) and the refrigerant (B) (the refrigerant described above). The refrigeration machine oil (A) contains a base oil, nanodiamond particles dispersed in the base oil, and the dispersant. Examples of the base oil include those exemplified and explained as the refrigeration machine oil contained in the composition for a refrigeration machine. The refrigeration machine oil (A) and the refrigerant (B) may each contain the components exemplified and explained as the other components described above.

The proportion of the base oil in the refrigeration machine oil (A) is not particularly limited, and is, for example, from 80 to 98 mass % and preferably from 90 to 95 mass % with respect to the total amount of the refrigeration machine oil (A).

In the refrigeration machine oil (A), the nanodiamond particles are preferably dispersed in nanometer order. An average dispersed particle size (D50, median diameter) of the nanodiamond particles in the refrigeration machine oil (A) is preferably from 2 to 240 nm, more preferably from 4 to 200 nm, more preferably from 5 to 100 nm, still more preferably from 10 to 70 nm, and particularly preferably from 12 to 40 nm. The average dispersed particle size can be measured using a dynamic light scattering method, The proportion of the nanodiamond particles in the refrigeration machine oil (A) is preferably from 1 to 10,000 mass ppm, more preferably from 5 to 1000 mass ppm, and still more preferably from 10 to 500 mass ppm with respect to the total amount of the refrigeration machine oil (A). When the proportion is 1 mass ppm or more, the friction coefficient in friction between sliding members in a refrigeration machine can be more sufficiently reduced. When the proportion is within the range described above, more excellent dispersibility of nanodiamond particles is obtained. The refrigeration machine oil (A) may be a concentrated liquid that is to be diluted at the time of use to obtain a reduced proportion of the nanodiamond particles. Thus, the proportion may be more than 10,000 mass ppm or 2 mass % or more. The refrigeration machine oil (A), which is excellent in dispersibility of the nanodiamond particles, can disperse the nanodiamond particles with a small dispersed particle size while reducing the addition amount of the dispersant even when the proportion is more than 10,000 mass ppm. From the viewpoint of achieving more excellent dispersibility of the nanodiamond particles, the proportion is preferably 10 mass % or less.

The proportion of the nanodiamond particles can be calculated from the absorbance at 350 nm. When the proportion of the surface-modified nanodiamond particles is small (e.g., 2000 mass ppm or less), the proportion may be determined based on a detected amount of a compound that modifies the surfaces of the nanodiamond particles, which is detected through high frequency inductively coupled plasma emission spectroscopy (ICP emission spectroscopy).

The content of the dispersant in the refrigeration machine oil (A) is preferably from 100 to 10,000 parts by mass, more preferably from 200 to 5000 parts by mass, and still more preferably 400 to 2000 parts by mass with respect to 100 parts by mass of the total amount of the nanodiamond particles.

The proportion of the extreme-pressure agent is preferably from 0.001 to 5 mass % and more preferably from 0.005 to 3 mass % with respect to the total amount of the refrigeration machine oil (A) from the viewpoint of further reducing the friction coefficient and the wear amount.

The refrigeration machine oil (A) has a friction coefficient of preferably 0.08 or less, more preferably 0.07 or less, still more preferably 0.05 or less, and particularly preferably 0.03 or less when used as a lubricant in a ring-on-disk friction test under conditions of a surface pressure of 2 MPa and a speed of 1.5 m/s. When the friction coefficient is 0.08 or less, the friction coefficient and the wear amount of the sliding member tend to be further reduced.

The refrigeration machine oil (A) may be produced, for example, by mixing nanodiamond particles, a dispersant, and, as necessary, other components in the base oil to disperse the nanodiamond particles. The refrigeration machine oil (A) using the surface-modified nanodiamond particles may also be produced through a reaction (modification) of the nanodiamond particles with a compound for surface treatment in the base oil. In this case, the solvent used in the modification can be used as it is as the base oil in the refrigeration machine oil (A). The solvent used in the modification may be directly used as the base oil in the refrigeration machine oil (A), or solvent exchange may be performed after the modification.

In the modification, the reaction between the compound for surface treatment and the nanodiamond particles is preferably performed while disintegrating or dispersing the nanodiamond particles when nanodiamond particle aggregates, which contains secondary particles formed by aggregation of nanodiamond particles, are included in the nanodiamond particles. This is because by doing so, the nanodiamond particle aggregates can be disintegrated into primary particles, the surfaces of the nanodiamond primary particles can be modified, and the dispersibility of nanodiamond particles in the refrigeration machine oil (A) can be improved.

Examples of the method for disintegrating or dispersing the nanodiamond particles include methods of processing the nanodiamond particles using a high shear mixer, a high shear mixer, a homomixer, a ball mill, a bead mill, a high pressure homogenizer, an ultrasonic homogenizer, a colloid mill, or a jet mill. Of these, implementing an ultrasonic treatment in the presence of a disintegrating medium (such as zirconia beads) is preferred.

The composition for a refrigeration machine can be produced, for example, by mixing the refrigeration machine oil (A) produced as described above and the refrigerant (B) while maintaining the state in which the nanodiamond particles are dispersed. The refrigeration machine oil (A) in which the nanodiamond particles are dispersed in the base oil and the composition for a refrigeration machine are thus obtained. The composition kit for a refrigeration machine is obtained by combining the refrigeration machine oil (A) and the refrigerant (B).

The composition for a refrigeration machine and a composition for a refrigeration machine provided by the composition kit for a refrigeration machine are compositions used for a refrigeration machine. Using the composition for a refrigeration machine in a refrigeration machine can reduce a friction coefficient in friction between sliding members in the refrigeration machine. In an aspect in which the composition for a refrigeration machine containing a refrigerant is used in a refrigeration machine, the composition for a refrigeration machine is required to have performance of promoting lubrication between sliding members in a state where pressure is applied thereon under a reduced pressure condition, and is required to have sufficient lubrication performance under conditions severer than that in the atmosphere. In this regard, the composition for a refrigeration machine of the present disclosure can reduce the friction coefficient between sliding members even when it is used under such severe conditions. Further, in order to reduce the friction coefficient between sliding members in a refrigeration machine, it is conceivable to reduce the viscosity of a composition for a refrigeration machine used as a lubricant. However, when the viscosity is reduced, there is a tendency that seizure of the sliding members easily occurs. In this regard, the composition for a refrigeration machine of the present disclosure can suppress the seizure of the sliding members and can reduce the wear amount of the sliding members.

The refrigeration machine includes, for example, a compressor, a condenser, an expansion mechanism (expansion valve or the like), an evaporator, and a dryer. Thus, the composition for a refrigeration machine can be used for such various devices that may be provided in the refrigeration machine. The composition for a refrigeration machine is used, for example, as a lubricant for lubricating a sliding portion provided in a compressor or the like. In this case, the composition for a refrigeration machine can be used as a working fluid for a refrigeration machine.

The lubricant may be a lubricant for initial running-in used for forming a low friction surface (running-in surface) at an initial use stage of a refrigeration machine having a sliding member. With the initial running-in lubricant, for example, recesses and protrusions of the surface of the sliding member are smoothed, or a modified surface is formed. After the running-in surface is formed, the initial running-in lubricant is removed through, for example, washing, and sliding using a lubricant for performing main lubrication is carried out. Here, the "lubricant for performing main lubrication" refers to a lubricant that is continuously present on a sliding part and is not normally removed during operation of the sliding member (during use of the refrigeration machine). Note that the initial running-in lubricant can be used as the lubricant for performing main lubrication, either as it is without being removed after the running-in surface is formed, or after being removed and then supplied again to the sliding part. For example, the refrigeration machine oil (A) described later may be used as the lubricant for initial running-in.

Examples of the refrigeration machine include air conditioners, refrigerators, vending machines, showcases, refrigeration systems, hot water supply systems, and heating systems. Examples of the air conditioner include: car air conditioners such as an open car air conditioner and an electric car air conditioner; gas heat pump (GHP) air conditioners; and indoor air conditioners.

Each aspect disclosed in the present specification can be combined with any other feature disclosed herein. Note that each of the configurations, combinations thereof, or the like in each of the embodiments are examples, and additions, omissions, replacements, and other changes to the configurations may be made as appropriate without departing from the spirit of the present disclosure. In addition, each aspect of the invention according to the present disclosure is not limited by the embodiments or the following examples but is limited only by the claims.

EXAMPLES

An embodiment of the present disclosure will be described in further detail below based on examples.

Example 1

Production of Surface Nanodiamond Particles

First, the formation of nanodiamonds by a detonation method was performed. In the present formation, first, a molded explosive attached with an electric detonator was placed inside a pressure-resistant vessel for detonation, and the vessel was sealed. The vessel was made of iron and had a capacity of 15 $m^3$. For the explosive, 0.50 kg of a mixture of TNT and RDX was used. The mass ratio of the TNT and RDX (TNT/RDX) in the explosive was 50/50. The electric detonator was then triggered to detonate the explosive in the vessel (formation of nanodiamond by detonation method). Then, the vessel was allowed to stand at room temperature for 24 hours to lower the temperatures of the vessel and its interior. After the cooling, a nanodiamond crude product (containing agglutinates of the nanodiamond particles and soot formed in the above detonation method), which adhered to the inner wall of the vessel, was scraped off with a spatula, and the nanodiamond crude product was thereby collected.

The nanodiamond crude product obtained by performing the formation as described above multiple times was then subjected to an acid treatment. Specifically, a slurry obtained by adding 6 L of a 10 mass % hydrochloric acid to 200 g of the nanodiamond crude product was subjected to a heat treatment under reflux at normal pressure conditions for 1 hour. The heating temperature in this acid treatment was from 85 to 100° C. Then, after cooling, the solid (containing the nanodiamond agglutinates and soot) was washed with water by decantation. The solid was repeatedly washed with water by decantation until the pH of a precipitation solution reached 2 from the low pH side.

An oxidation treatment was then performed. Specifically, 6 L of 98 mass % sulfuric acid and 1 L of 69 mass % nitric acid were added to the precipitate solution (containing the nanodiamond agglutinates) obtained through decantation after the acid treatment to form a slurry, and then the slurry was subjected to heat treatment under reflux at normal pressure conditions for 48 hours. The heating temperature in this oxidation treatment was from 140 to 160° C. Then, after cooling, the solid (containing the nanodiamond agglutinates) was washed with water by decantation. The initial supernatant from the water washing was colored, and thus washing of the solid with water by decantation was repeated until the supernatant became visually transparent.

Next, 1000 mL of the nanodiamond-containing solution obtained through the water washing treatment described above was subjected to spray drying using a spray dryer (trade name "Spray Dryer B-290", available from Nihon Buchi K.K.) (drying). Consequently, 50 g of nanodiamond powder was obtained.

The nanodiamond particles obtained in the drying in an amount of 0.3 g was weighed into a reaction vessel, then, 13.5 g of MIBK and 1.2 g of hexyltrimethoxysilane as a silane compound were added thereto, and the mixture was stirred for 10 minutes.

After stirring, 36 g of zirconia beads (trade name "YTZ", available from Tosoh Corporation; diameter: 30 μm) was added. After the addition, under cooling in ice water, the mixture was subjected to an ultrasonic treatment for 20 hours using an ultrasonic disperser (model "UP-400s", available from Hielscher Ultrasonics GmbH) in a state where a tip of an oscillator of the ultrasonic disperser was immersed in the solution in the reaction vessel, and the nanodiamond particles and the silane compound were reacted. The mixture was initially gray, but the particle size gradually became smaller, and the dispersion state improved. Finally, the mixture became a uniform, black liquid. This is believed to be because nanodiamond particles were sequentially disintegrated from the nanodiamond particle aggregate (disintegration), the silane compound acted on the nanodiamond particles in a dissociated state and bonded to the particles, and the surface-modified nanodiamond particles were stably dispersed in MIBK. A nanodiamond dispersion (MIBK dispersion) was thus obtained.

Production of Nanodiamond-Dispersed Composition for Refrigeration Machine

A dispersant (trade name "BYK-9077", available from BYK-Chemie GmbH) was added to the surface-modified nanodiamond dispersion obtained above and stirred. Then, MIBK was distilled off by a rotary evaporator, and a refrigeration machine oil (trade name "Daphne Hermetic Oil FVC68D", available from Idemitsu Kosan Co., Ltd.) was added thereto. Consequently, a nanodiamond-dispersed composition for a refrigeration machine (nanodiamond concentration: 10 mass ppm, dispersant concentration: 100 mass ppm) was thus produced. Note that the nanodiamond concentration was calculated from the absorbance at 350 nm.

Example 2

Production of Nanodiamond-Dispersed Composition for Refrigeration Machine A dispersant (trade name "AJISPER PN411", available from Ajinomoto Fine-Techno Co., Inc.) was added to the surface-modified nanodiamond dispersion produced in Example 1, and stirred. Then, MIBK was distilled off by a rotary evaporator, and a refrigeration machine oil (trade name "Daphne Hermetic Oil FVC68D", available from Idemitsu Kosan Co., Ltd.) was added thereto. Consequently, a nanodiamond-dispersed composition for a refrigeration machine (nanodiamond concentration: 10 mass ppm, dispersant concentration: 50 mass ppm) was thus produced. Note that the nanodiamond concentration was calculated from the absorbance at 350 nm.

Comparative Example 1

"Daphne Hermetic Oil FVC68D" (trade name, available from Idemitsu Kosan Co., Ltd.) was used as the refrigeration machine oil.

Evaluation

Each of the nanodiamond-dispersed compositions for a refrigeration machine obtained in Examples and Comparative Examples was evaluated as follows.

(1) Ring-On-Disk Friction Test (in the Atmosphere)

Each of the nanodiamond-dispersed compositions for a refrigeration machine obtained in Example 1 and Comparative Example 1 was used as a lubricating oil sample. A friction test was performed using a ring-on-disk type thrust friction and wear tester (disk contact surface system) (device name "AT-800", available from A&D Company, Limited). As a ring and a disk serving as the test pieces, a ring made of cast iron having an outer diameter of 44 mm and an inner diameter of 32 mm in a contact surface and a disk made of cast iron having a diameter of 50 mm in the contact surface were used, both of which were subjected to surface polishing (Ra=0.3 μm or less). At the start of the test, the disk was immersed in the composition for a refrigeration machine, and the test was conducted at room temperature.

Figure 2:
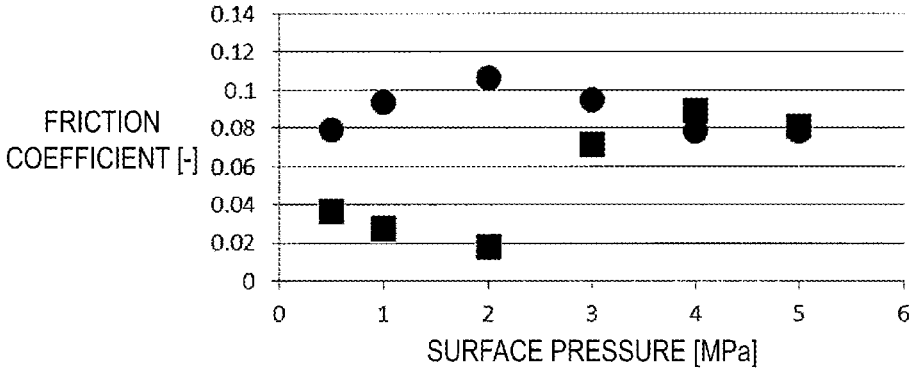
FIG. 2 is a graph illustrating friction coefficients measured by a ring-on-disk friction test (in the atmosphere, at a sliding speed of 1.5 m/s) when the compositions for a refrigeration machine of Example 1 and Comparative Example 1 were used as lubricants.
Figure 3:
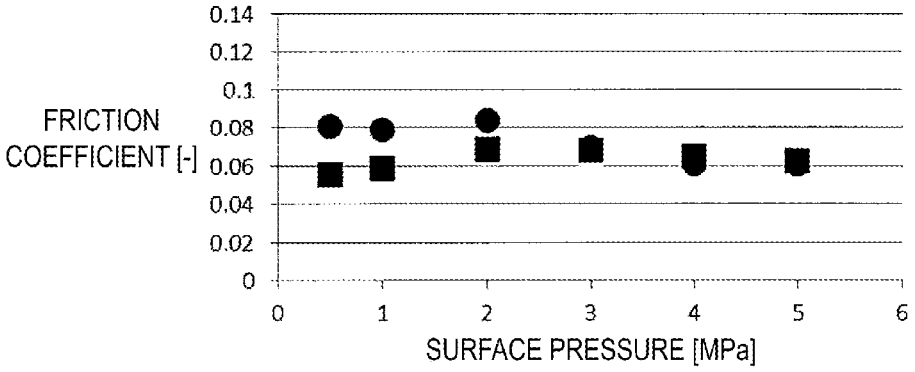
FIG. 3 is a graph illustrating friction coefficients measured by a ring-on-disk friction test (in the atmosphere, at a sliding speed of 2.5 m/s) when the compositions for a refrigeration machine of Example 1 and Comparative Example 1 were used as lubricants.
Figure 4:
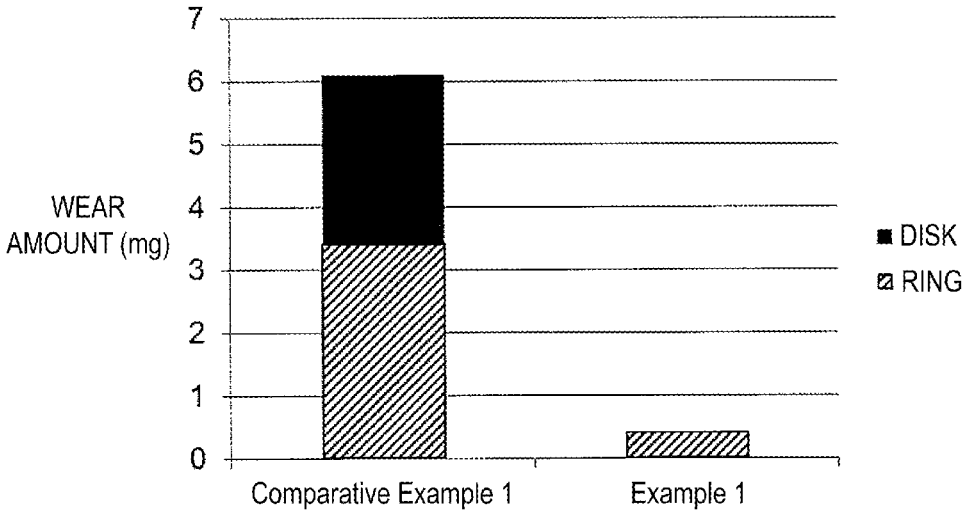
FIG. 4 is a graph illustrating wear amounts measured in a ring-on-disk friction test (in the atmosphere) when the compositions for a refrigeration machine of Example 1 and Comparative Example 1 were used as lubricants.

Comparison results of Example 1 and Comparative Example 1 are shown in FIGS. 1 to 3 (friction coefficient) and FIG. 4 (wear amount). FIG. 1 is a graph at a sliding speed of 0.5 m/s, FIG. 2 is a graph at a sliding speed of 1.5 m/s, and FIG. 3 is a graph at a sliding speed of 2.5 m/s. In the figures, black squares (■) indicate Example (with nanodiamond particles) and black circles (•) indicate Comparative Example (without nanodiamond particles).

(2) Ring-On-Disk Friction Test (in Refrigerant)

The nanodiamond-dispersed compositions for a refrigeration machine obtained in Examples 1 and 2 and Comparative Example 1 were used as lubricating oil samples. A friction test was performed using a ring-on-disk type thrust friction and wear tester (disk contact surface system) (device name "AT-800", available from A&D Company, Limited). As a ring and a disk serving as the test pieces, a ring made of cast iron having an outer diameter of 44 mm and an inner diameter of 32 mm in a contact surface and a disk made of cast iron having a diameter of 50 mm in the contact surface were used, both of which were subjected to surface polishing (Ra=0.3 μm or less). At the start of the test, 300 mL of each lubricating oil sample was put on the sliding surface of the disk surface, 0.2 kg of a refrigerant was added under reduced pressure by a vacuum pump, and then the test was performed in a state of being pressurized. Note that, as the refrigerant, R32 was used in the comparative tests of Example 1 and Comparative Example 1, and R410A was used in the comparative tests of Example 2 and Comparative Example 1.

Figure 5:
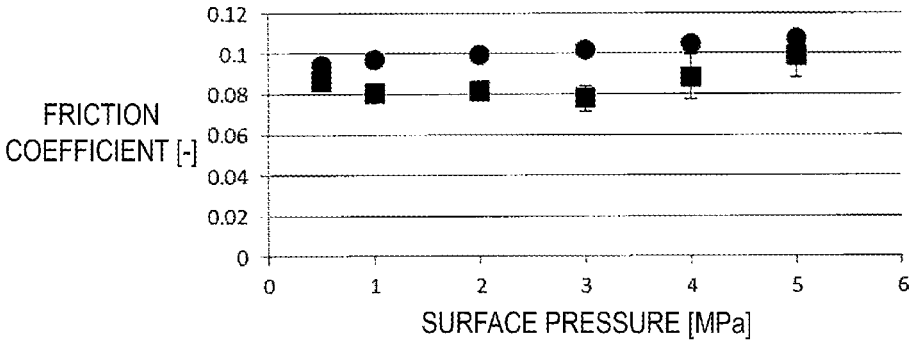
FIG. 5 is a graph illustrating friction coefficients measured by a ring-on-disk friction test (in a refrigerant, at a sliding speed of 0.5 m/s) when the compositions for a refrigeration machine of Example 1 and Comparative Example 1 were used as lubricants.
Figure 6:
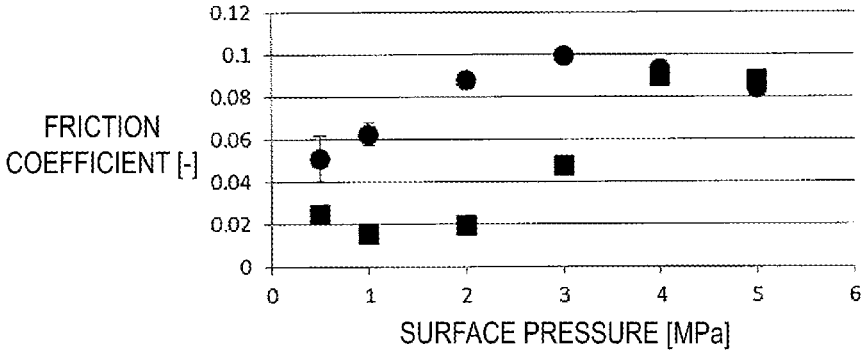
FIG. 6 is a graph illustrating friction coefficients measured by a ring-on-disk friction test (in a refrigerant, at a sliding speed of 1.5 m/s) when the compositions for a refrigeration machine of Example 1 and Comparative Example 1 were used as lubricants.
Figure 7:
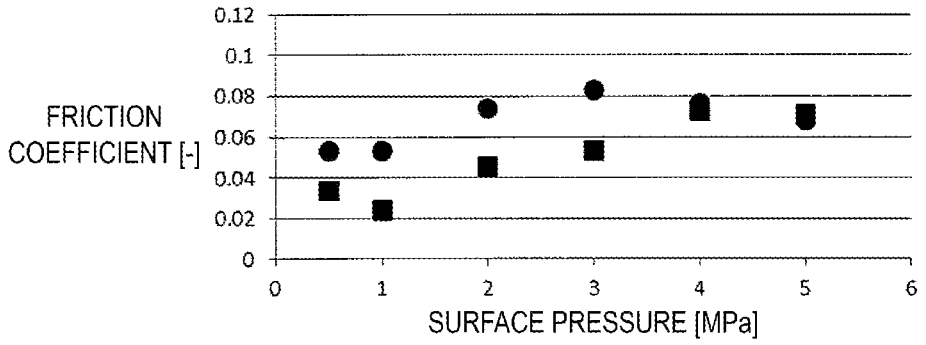
FIG. 7 is a graph illustrating friction coefficients measured by a ring-on-disk friction test (in a refrigerant, at a sliding speed of 2.5 m/s) when the compositions for a refrigeration machine of Example 1 and Comparative Example 1 were used as lubricants.
Figure 8:
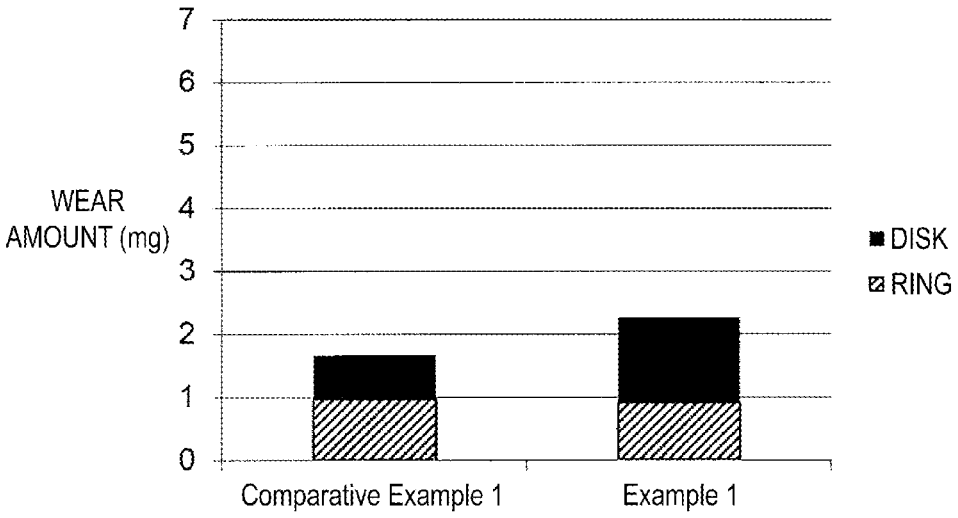
FIG. 8 is a graph illustrating wear amounts measured in a ring-on-disk friction test (in a refrigerant) when the compositions for a refrigeration machine of Example 1 and Comparative Example 1 were used as lubricants.
Figure 9:
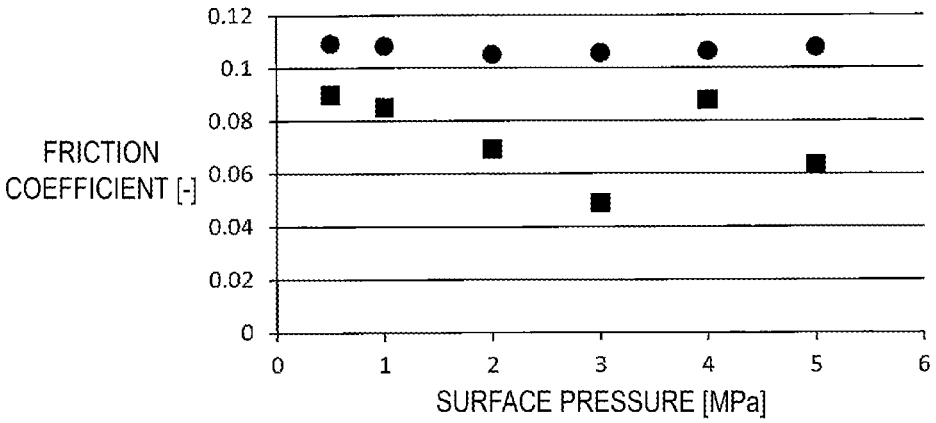
FIG. 9 is a graph illustrating friction coefficients measured by a ring-on-disk friction test (in a refrigerant, at a sliding speed of 0.5 m/s) when the compositions for a refrigeration machine of Example 2 and Comparative Example 1 were used as lubricants.
Figure 10:
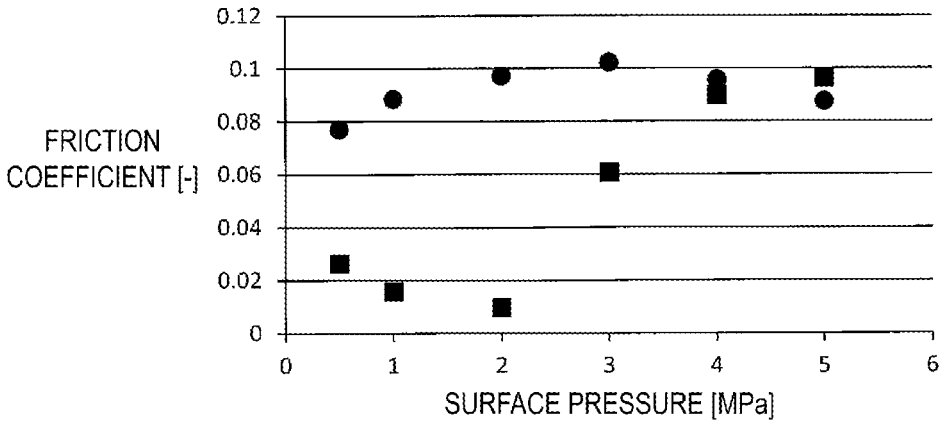
FIG. 10 is a graph illustrating friction coefficients measured by a ring-on-disk friction test (in a refrigerant, at a sliding speed of 1.5 m/s) when the compositions for a refrigeration machine of Example 2 and Comparative Example 1 were used as lubricants.
Figure 11:
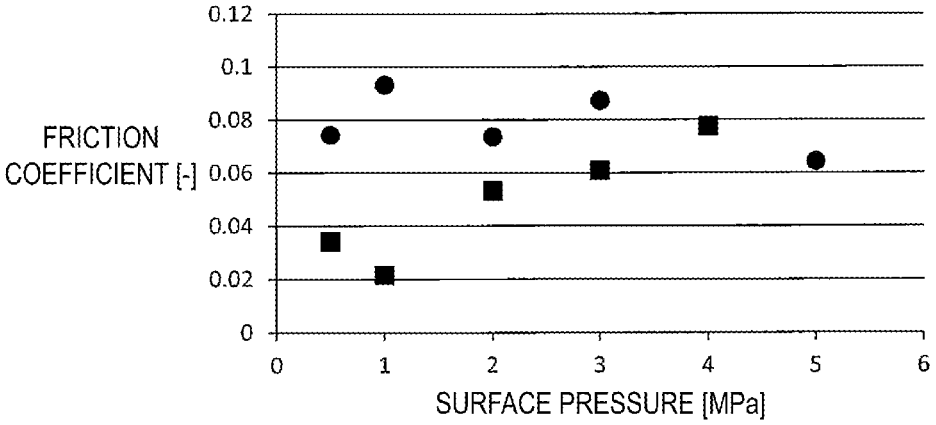
FIG. 11 is a graph illustrating friction coefficients measured by a ring-on-disk friction test (in a refrigerant, at a sliding speed of 2.5 m/s) when the compositions for a refrigeration machine of Example 2 and Comparative Example 1 were used as lubricants.
Figure 12:
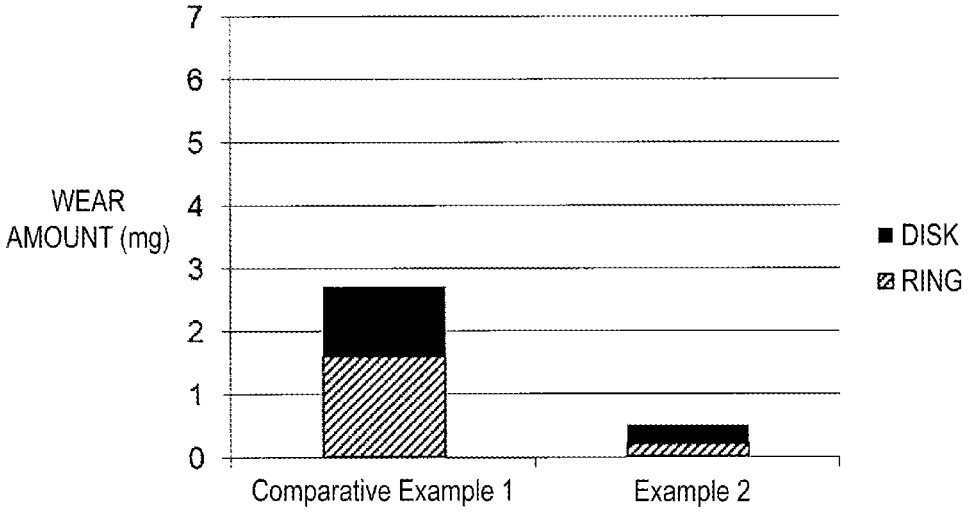
FIG. 12 is a graph illustrating wear amounts measured in a ring-on-disk friction test (in a refrigerant) when the compositions for a refrigeration machine of Example 2 and Comparative Example 1 were used as lubricants.

The comparison results of Example 1 and Comparative Example 1 are shown in FIGS. 5 to 7 (friction coefficient) and FIG. 8 (wear amount), and the comparison results of Example 2 and Comparative Example 1 are shown in FIGS. 9 to 11 (friction coefficient) and FIG. 12 (wear amount). FIGS. 5 and 9 are graphs at a sliding speed of 0.5 m/s, FIGS. 6 and 10 are graphs at a sliding speed of 1.5 m/s, and FIGS. 7 and 11 are graphs at a sliding speed of 2.5 m/s. In the figures, black squares (■) indicate Example (with nanodiamond particles) and black circles (•) indicate Comparative Example (without nanodiamond particles).

As the test conditions in the ring-on-disk friction tests (1) and (2), a step system was employed in which the sliding speed was changed stepwise to 0.5 m/s, 1.5 m/s, and 2.5 m/s while the surface-to-surface contact pressure was changed stepwise from 0.5 MPa to 1.0 MPa, 2.0 MPa, 3.0 MPa, 4.0 MPa, and 5.0 MPa at the respective sliding speeds. Specifically, first, the surface-to-surface contact pressure was changed stepwise from 0.5 MPa to 1.0 MPa, 2.0 MPa, 3.0 MPa, 4.0 MPa, and 5.0 MPa while the sliding speed was maintained at 0.5 m/s. Thereafter, the sliding speed was changed to 1.5 m/s, and at the same time, the surface-to-surface contact pressure was returned to 0.5 MPa, and in the same manner, the surface-to-surface contact pressure was changed stepwise to 5.0 MPa while the sliding speed was maintained. Thereafter, the sliding speed was changed to 2.5 m/s, and at the same time, the surface-to-surface contact pressure was returned to 0.5 MPa, and in the same manner, the surface-to-surface contact pressure was changed stepwise to 5.0 MPa while the sliding speed was maintained. The holding time for each stage was 5 minutes.

The wear amount of the ring and the disk was defined as a mass difference of the ring and the disk before and after the ring-on-disk test.

As shown in FIGS. 1 to 3, 5 to 7, and 9 to 11, it was determined that the friction coefficient tends to be lower when the composition for a refrigeration machine in which nanodiamond particles were dispersed was used as the lubricant (Examples) than when the composition for a refrigeration machine containing no nanodiamond particles was used as the lubricant (Comparative Example). In addition, the friction coefficient was particularly reduced in a range where the surface-to-surface contact pressure was 4 MPa or less. As shown in FIGS. 4, 8, and 12, when the composition for a refrigeration machine in which nanodiamond particles were dispersed was used as the lubricant (Examples), the wear amount was equivalent to or significantly reduced compared to that when the composition for a refrigeration machine containing no nanodiamond particles was used as the lubricant (Comparative Example).

Hereinafter, variations of the invention according to the present disclosure will be described.

[Supplementary Note 1] A composition for a refrigeration machine including a refrigeration machine oil, nanodiamond particles dispersed in the refrigeration machine oil, and a dispersant.

[Supplementary Note 2] The composition for a refrigeration machine according to Supplementary Note 1, wherein the refrigeration machine oil contains a polyvinyl ether, a polyol ester, a polyalkylene glycol, an alkylated aromatic hydrocarbon compound, or a mineral oil.

[Supplementary Note 3] The composition for a refrigeration machine according to Supplementary Note 1 or 2, wherein the dispersant includes a dispersant (I) having a mass-average molecular weight of 500 or more and an amine value of 15 mg KOH/g or more and/or a fatty acid ester-based dispersant (II).

[Supplementary Note 4] The composition for a refrigeration machine according to Supplementary Note 3, wherein the dispersant (I) has a mass-average molecular weight of 650 or more, and preferably 950 or more.

[Supplementary Note 5] The composition for a refrigeration machine according to Supplementary Note 3 or 4, wherein the dispersant (I) has a mass-average molecular weight of 20,000 or less, and preferably 10,000 or less.

[Supplementary Note 6] The composition for a refrigeration machine according to any one of Supplementary Notes 3 to 5, wherein the amine value of the dispersant (I) is 18 mg KOH/g or more, preferably 20 mg KOH/g or more, and more preferably 30 mg KOH/g or more.

[Supplementary Note 7] The composition for a refrigeration machine according to any one of Supplementary Notes 3 to 6, wherein the amine value of the dispersant (I) is 100 mg KOH/g or less, preferably 90 mg KOH/g or less, and more preferably 60 mg KOH/g or less.

[Supplementary Note 8] The composition for a refrigeration machine according to any one of Supplementary Notes 3 to 7, wherein the dispersant (I) is one or more compounds selected from a compound having a structure derived from a polyalkylene glycol monoalkyl ether, in particular, a structure derived from polyethylene glycol monoalkyl ether or a structure derived from polypropylene glycol monoalkyl ether, a compound having a carbamate structure, and a compound having a structure derived from polycaprolactone.

[Supplementary Note 9] The composition for a refrigeration machine according to any one of Supplementary Notes 3 to 8, wherein the dispersant (II) has an acid value of 40 mg KOH/g or less, preferably 35 mg KOH/g or less, more preferably 30 mg KOH/g or less, still more preferably 20 mg KOH/g or less, and particularly preferably 6 mg KOH/g or less.

[Supplementary Note 10] The composition for a refrigeration machine according to any one of Supplementary Notes 3 to 9, wherein the dispersant (II) has an acid value of 0.1 mg KOH/g or more, preferably 0.3 mg KOH/g or more, and more preferably 0.5 mg KOH/g or more.

[Supplementary Note 11] The composition for a refrigeration machine according to any one of Supplementary Notes 3 to 10, wherein the dispersant (II) has an amine value of 5 mg KOH/g or less, preferably 1 mg KOH/g or less, more preferably 0.5 mg KOH/g or less, still more preferably 0.1 mg KOH/g or less, and particularly preferably 0 mg KOH/g.

[Supplementary Note 12] The composition for a refrigeration machine according to any one of Supplementary Notes 3 to 11, wherein the dispersant (II) has an average molecular weight Mp of 300 or more, preferably 1000 or more, for example from 1000 to 100,000, and more preferably 3000 or more, for example from 3000 to 10,000.

[Supplementary Note 13] The composition for a refrigeration machine according to any one of Supplementary Notes 3 to 12, wherein the dispersant (II) has a mass loss rate of 30% or less, preferably 25% or less, more preferably 20% or less, and still more preferably 15% or less when the dispersant (II) is held in an air atmosphere at a temperature of 200° C. for 180 minutes.

[Supplementary Note 14] The composition for a refrigeration machine according to any one of Supplementary Notes 3 to 13, wherein the dispersant (II) contains an acidic functional group.

[Supplementary Note 15] The composition for a refrigeration machine according to any one of Supplementary Notes 3 to 14, wherein the dispersant (II) is a higher fatty acid ester-based dispersant.

[Supplementary Note 16] The composition for a refrigeration machine according to any one of Supplementary Notes 1 to 15, wherein the refrigeration machine oil has an SP value of from 6.0 to 12.0 $(cal/cm^3)^{1/2}$.

[Supplementary Note 17] The composition for a refrigeration machine according to any one of Supplementary Notes 1 to 16, wherein the nanodiamond particles are a surface-modified nanodiamond including a surface-modifying group that modifies surfaces of the nanodiamond particles, the surface-modifying group containing an organic group.

[Supplementary Note 18] The composition for a refrigeration machine according to Supplementary Note 17, wherein the organic group is an organic group having 4 or more carbons, (for example, from 4 to 25 carbons), 6 or more carbons (for example, from 6 to 22 carbons), or 8 or more carbons (for example, from 8 to 20 carbons).

[Supplementary Note 19] The composition for a refrigeration machine according to Supplementary Note 17 or 18, wherein the surface-modifying group is a group represented by Formula (1) below:

$$—X—R \quad (I)$$

where X represents a linking group, and a bond extending left from X binds to the nanodiamond, R represents a monovalent organic group, and an atom that binds to X is a carbon atom.

[Supplementary Note 20] The composition for a refrigeration machine according to Supplementary Note 19, wherein the group represented by Formula (I) is a group represented by Formula (1) below or a group containing a polyglycerin chain.

$$—X^1—R^1 \quad (1)$$

where $X^1$ represents —O—Si—, —Si—, —NH—, —O—, —O—C(=O)—, —C(=O)—O—, —NH—C(=O)—, —C(=O)—NH—, or —S—, and a bond extending left from $X^1$ binds to the nanodiamond, $R^1$ represents a substituted or unsubstituted monovalent hydrocarbon group, and an atom that binds to $X^1$ is a carbon atom.

[Supplementary Note 21] The composition for a refrigeration machine according to Supplementary Note 20, wherein the number of carbons in $R^1$ is from 4 to 25, preferably from 6 to 22, and more preferably from 8 to 20.

[Supplementary Note 22] The composition for a refrigeration machine according to any one of Supplementary Notes 1 to 21, wherein the nanodiamond particles are dispersed in nanometer order.

[Supplementary Note 23] The composition for a refrigeration machine according to any one of Supplementary Notes 1 to 22, wherein the nanodiamond particles in the composition for a refrigeration machine have an average dispersed particle size (D50, median diameter) of from 2 to 240 nm, preferably from 4 to 200 nm, more preferably from 5 to 100 nm, still more preferably from 6 to 70 nm, still more preferably from 10 to 60 nm, still more preferably from 10 to 40 nm, and particularly preferably from 11 to 30 nm.

[Supplementary Note 24] The composition for a refrigeration machine according to any one of Supplementary Notes 1 to 23, wherein a proportion of the nanodiamond particles contained in the composition for a refrigeration machine is from 1 to 10000 mass ppm, preferably from 5 to 1000 mass ppm, and more preferably from 10 to 500 mass ppm with respect to a total amount of the refrigeration machine oil.

[Supplementary Note 25] The composition for a refrigeration machine according to any one of Supplementary Notes 1 to 24, wherein a content of the dispersant in the composition for a refrigeration machine is from 100 to 10000 parts by mass, preferably from 200 to 5000 parts by mass, and more preferably from 400 to 2000 parts by mass with respect to 100 parts by mass of a total amount of the nanodiamond particles.

[Supplementary Note 26] The composition for a refrigeration machine according to any one of Supplementary Notes 1 to 25, the composition further including an extreme-pressure agent, preferably a phosphorus-based extreme-pressure agent, a metal salt of carboxylic acid, or a sulfur-based extreme-pressure agent, and more preferably a phosphorus-based extreme-pressure agent.

[Supplementary Note 27] The composition for a refrigeration machine according to Supplementary Note 26, wherein a proportion of the extreme-pressure agent is from 0.0005 to 3 mass %, preferably from 0.002 to 2 mass % with respect to a total amount of the composition for a refrigeration machine.

[Supplementary Note 28] The composition for a refrigeration machine according to any one of Supplementary Notes 1 to 27, wherein the composition has a haze value of 5 or less, preferably 3 or less, and more preferably 1 or less.

[Supplementary Note 29] The composition for a refrigeration machine according to any one of Supplementary Notes 1 to 28, wherein the composition has a friction coefficient of 0.08 or less when the composition is used as a lubricant in a ring-on-disk friction test under conditions of a surface pressure of 2 MPa and a speed of 1.5 m/s.

[Supplementary Note 30] The composition for a refrigeration machine according to any one of Supplementary Notes 1 to 29, the composition being for use in a compressor of a refrigeration machine.

[Supplementary Note 31] The composition for a refrigeration machine according to any one of Supplementary Notes 1 to 30, wherein the refrigeration machine is an air conditioner.

[Supplementary Note 32] A composition kit for a refrigeration machine, the composition kit including: a refrigeration machine oil (A) including a base oil and nanodiamond particles dispersed in the base oil; and a refrigerant (B).

[Supplementary Note 33] The composition kit for a refrigeration machine according to Supplementary Note 32, wherein a proportion of the base oil contained in the refrigeration machine oil (A) is from 80 to 98 mass %, and preferably from 90 to 95 mass % with respect to a total amount of the refrigeration machine oil (A).

[Supplementary Note 34] The composition kit for a refrigeration machine according to Supplementary Note 32 or 33, wherein the refrigeration machine oil contains a polyvinyl ether, a polyol ester, a polyalkylene glycol, an alkylated aromatic hydrocarbon compound, or a mineral oil.

[Supplementary Note 35] The composition kit for a refrigeration machine according to any one of Supplementary Notes 32 to 34, wherein the dispersant includes a dispersant (I) having a mass-average molecular weight of 500 or more and an amine value of 15 mg KOH/g or more, and/or a fatty acid ester-based dispersant (II).

[Supplementary Note 36] The composition kit for a refrigeration machine according to Supplementary Note 35, wherein the dispersant (I) has a mass-average molecular weight of 650 or more, and preferably 950 or more.

[Supplementary Note 37] The composition kit for a refrigeration machine according to Supplementary Note 35 or 36, wherein the dispersant (I) has a mass-average molecular weight of 20,000 or less, and preferably 10,000 or less.

[Supplementary Note 38] The composition kit for a refrigeration machine according to any one of Supplementary Notes 35 to 37, wherein the dispersant (I) has an amine value of 18 mg KOH/g or more, preferably 20 mg KOH/g or more, and more preferably 30 mg KOH/g or more.

[Supplementary Note 39] The composition kit for a refrigeration machine according to any one of Supplementary Notes 35 to 38, wherein the amine value of the dispersant (I) is 100 mg KOH/g or less, preferably 90 mg KOH/g or less, and more preferably 60 mg KOH/g or less.

[Supplementary Note 40] The composition kit for a refrigeration machine according to any one of Supplementary Notes 35 to 39, wherein the dispersant (I) is one or more compounds selected from a compound having a structure derived from a polyalkylene glycol monoalkyl ether, in particular, a structure derived from polyethylene glycol monoalkyl ether or a structure derived from polypropylene glycol monoalkyl ether, a compound having a carbamate structure, and a compound having a structure derived from polycaprolactone.

[Supplementary Note 41] The composition kit for a refrigeration machine according to any one of Supplementary Notes 35 to 40, wherein the dispersant (II) has an acid value of 40 mg KOH/g or less, preferably 35 mg KOH/g or less, more preferably 30 mg KOH/g or less, still more preferably 20 mg KOH/g or less, and particularly preferably 6 mg KOH/g or less.

[Supplementary Note 42] The composition kit for a refrigeration machine according to any one of Supplementary Notes 35 to 41, wherein the dispersant (II) has an acid value of 0.1 mg KOH/g or more, preferably 0.3 mg KOH/g or more, and more preferably 0.5 mg KOH/g or more.

[Supplementary Note 43] The composition kit for a refrigeration machine according to any one of Supplementary Notes 35 to 42, wherein the dispersant (II) has an amine value of 5 mg KOH/g or less, preferably 1 mg KOH/g or less, more preferably 0.5 mg KOH/g or less, still more preferably 0.1 mg KOH/g or less, and particularly preferably 0 mg KOH/g.

[Supplementary Note 44] The composition kit for a refrigeration machine according to any one of Supplementary Notes 35 to 43, wherein the dispersant (II) has an average molecular weight Mp of 300 or more, preferably 1000 or more, for example from 1000 to 100,000, and more preferably 3000 or more, for example from 3000 to 10,000.

[Supplementary Note 45] The composition kit for a refrigeration machine according to any one of Supplementary Notes 35 to 44, wherein the dispersant (II) has a mass loss rate of 30% or less, preferably 25% or less, more preferably 20% or less, and still more preferably 15% or less when the dispersant (II) is held in an air atmosphere at a temperature of 200° C. for 180 minutes.

[Supplementary Note 46] The composition kit for a refrigeration machine according to any one of Supplementary Notes 35 to 45, wherein the dispersant (II) contains an acidic functional group.

[Supplementary Note 47] The composition kit for a refrigeration machine according to any one of Supplementary Notes 35 to 46, wherein the dispersant (II) is a higher fatty acid ester-based dispersant.

[Supplementary Note 48] The composition kit for a refrigeration machine according to any one of Supplementary Notes 32 to 47, wherein the refrigeration machine oil has an SP value of from 6.0 to 12.0 $(cal/cm^3)^{1/2}$.

[Supplementary Note 49] The composition kit for a refrigeration machine according to any one of Supplementary Notes 32 to 48, wherein the nanodiamond particles are a surface-modified nanodiamond including a surface-modifying group that modifies surfaces of the nanodiamond particles, the surface-modifying group containing an organic group.

[Supplementary Note 50] The composition kit for a refrigeration machine according to Supplementary Note 49, wherein the organic group is an organic group having 4 or more carbons (for example, from 4 to 25 carbons), 6 or more carbons (for example, from 6 to 22 carbons), or 8 or more carbons (for example, from 8 to 20 carbons).

[Supplementary Note 51] The composition kit for a refrigeration machine according to Supplementary Note 49 or 50, wherein the surface-modifying group is a group represented by Formula (I) below:

$$—X—R \quad (I)$$

where X represents a linking group, and a bond extending left from X binds to the nanodiamond, R represents a monovalent organic group, and an atom that binds to X is a carbon atom.

[Supplementary Note 52] The composition kit for a refrigeration machine according to Supplementary Note 51, wherein the group represented by Formula (I) is a group represented by Formula (1) below or a group containing a polyglycerin chain.

$$—X^1—R^1 \quad (1)$$

where $X^1$ represents —O—Si—, —Si—, —NH—, —O—, —O—C(=O)—, —C(=O)—O—, —NH—C(=O)—, —C(=O)—NH—, or —S—, and a bond extending left from $X^1$ binds to the nanodiamond, $R^1$ represents a substituted or unsubstituted monovalent hydrocarbon group, and an atom that binds to $X^1$ is a carbon atom.

[Supplementary Note 53] The composition kit for a refrigeration machine according to Supplementary Note 52, wherein the number of carbons in $R^1$ is from 4 to 25, preferably from 6 to 22, and more preferably from 8 to 20.

[Supplementary Note 54] The composition kit for a refrigeration machine according to any one of Supplementary Notes 32 to 53, wherein the nanodiamond particles are dispersed in nanometer order in the refrigeration machine oil (A).

[Supplementary Note 55] The composition kit for a refrigeration machine according to any one of Supplementary Notes 32 to 54, wherein the nanodiamond particles in the refrigeration machine oil (A) has an average dispersed particle size (D50, median diameter) of from 2 to 240 nm, preferably from 4 to 200 nm, more preferably from 5 to 100 nm, still more preferably from 10 to 70 nm, and particularly preferably from 12 to 40 nm.

[Supplementary Note 56] The composition kit for a refrigeration machine according to any one of Supplementary Notes 32 to 55, wherein a proportion of the nanodiamond particles contained in the refrigeration machine oil (A) is from 1 to 10000 mass ppm, preferably from 5 to 1000 mass ppm, and more preferably from 10 to 500 mass ppm with respect to a total amount of the refrigeration machine oil (A).

[Supplementary Note 57] The composition kit for a refrigeration machine according to any one of Supplementary Notes 32 to 56, wherein a content of the dispersant in the refrigeration machine oil (A) is from 100 to 10000 parts by mass, preferably from 200 to 5000 parts by mass, and more preferably from 400 to 2000 parts by mass with respect to 100 parts by mass of a total amount of the nanodiamond particles.

[Supplementary Note 58] The composition kit for a refrigeration machine according to any one of Supplementary Notes 32 to 57, wherein the refrigeration machine oil (A) includes an extreme-pressure agent.

[Supplementary Note 59] The composition kit for a refrigeration machine according to Supplementary Note 58, wherein a proportion of the extreme-pressure agent is 0.001 to 5 mass %, and preferably 0.005 to 3 mass % with respect to a total amount of the refrigeration machine oil (A).

[Supplementary Note 60] The composition kit for a refrigeration machine according to any one of Supplementary Notes 32 to 53, wherein the refrigeration machine oil (A) has a friction coefficient of 0.08 or less when the refrigeration machine oil (A) is used as a lubricant in a ring-on-disk friction test under conditions of a surface pressure of 2 MPa and a speed of 1.5 m/s.

[Supplementary Note 61] The composition kit for a refrigeration machine according to any one of Supplementary Notes 32 to 60, the composition being for use in a compressor of a refrigeration machine.

[Supplementary Note 62] The composition kit for a refrigeration machine according to any one of Supplementary Notes 32 to 61, wherein the refrigeration machine is an air conditioner.

INDUSTRIAL APPLICABILITY

The composition for a refrigeration machine according to the present disclosure can be used for a refrigeration machine or an air conditioner using a refrigeration machine.

The invention claimed is:

1. A composition for a refrigeration machine, the composition comprising:

a refrigeration machine oil;

nanodiamond particles dispersed in the refrigeration machine oil; and a dispersant and a refrigerant, wherein a proportion of the nanodiamond particles contained in the composition for a refrigeration machine is from 1 to 500 mass ppm with respect to a total amount of the refrigeration machine oil.

2. The composition for a refrigeration machine according to claim 1, wherein the refrigeration machine oil contains a polyvinyl ether, a polyol ester, a polyalkylene glycol, an alkylated aromatic hydrocarbon compound, or a mineral oil.

3. The composition for a refrigeration machine according to claim 1, wherein the dispersant includes a dispersant (I) having a mass-average molecular weight of 500 or more and an amine value of 15 mg KOH/g or more and/or a fatty acid ester-based dispersant (II).

4. The composition for a refrigeration machine according to claim 1, wherein the refrigeration machine oil has an SP value of from 6.0 to 12.0 $(cal/cm^3)^{1/2}$.

5. The composition for a refrigeration machine according to claim 1, wherein the composition has a friction coefficient of 0.08 or less when the composition is used as a lubricant in a ring-on-disk friction test under conditions of a surface pressure of 2 MPa and a speed of 1.5 m/s.

6. The composition for a refrigeration machine according to claim 1, wherein the composition is for use in a compressor of a refrigeration machine.

7. The composition for a refrigeration machine according to claim 1, wherein the refrigeration machine is an air conditioner.

8. A composition kit for a refrigeration machine, the composition kit comprising:

a refrigeration machine oil (A) containing a base oil and nanodiamond particles dispersed in the base oil; and a refrigerant (B), wherein a proportion of the nanodiamond particles contained in the refrigeration machine oil for a refrigeration machine is from 1 to 500 mass ppm with respect to a total amount of the refrigeration machine oil.

9. The composition kit for a refrigeration machine according to claim 8, wherein the refrigeration machine oil (A) has a friction coefficient of 0.08 or less when the refrigeration machine oil (A) is used as a lubricant in a ring-on-disk friction test under conditions of a surface pressure of 2 MPa and a speed of 1.5 m/s.

* * * * *